US009153196B2

(12) United States Patent
Hong et al.

(10) Patent No.: US 9,153,196 B2
(45) Date of Patent: Oct. 6, 2015

(54) DISPLAY DEVICE AND DRIVING METHOD THEREOF

(71) Applicant: Samsung Display Co., Ltd., Yongin, Gyeonggi-Do (KR)

(72) Inventors: Seok Ha Hong, Yongin-si (KR); Dae-Gwang Jang, Incheon (KR); Sang Mi Kim, Yongin-si (KR); Ung Gyu Min, Seoul (KR); Ji Myoung Seo, Daegu (KR); Bong Hyun You, Yongin-si (KR); Hyun Sik Hwang, Hwaseong-si (KR); Gi Geun Kim, Seoul (KR); Jong Hee Kim, Hwaseong-si (KR); Kyoung Won Lee, Seoul (KR)

(73) Assignee: Samsung Display Co., Ltd. (KR)

( * ) Notice: Subject to any disclaimer, the term of this patent is extended or adjusted under 35 U.S.C. 154(b) by 99 days.

(21) Appl. No.: 13/939,566

(22) Filed: Jul. 11, 2013

(65) Prior Publication Data

US 2014/0160182 A1 Jun. 12, 2014

(30) Foreign Application Priority Data

Dec. 12, 2012 (KR) ..... 10-2012-0144600

(51) Int. Cl.

| | |
|---|---|
| ***G09G 3/36*** | (2006.01) |
| ***G09G 5/00*** | (2006.01) |
| ***G09G 5/02*** | (2006.01) |

(52) U.S. Cl.

CPC ..... *G09G 5/00* (2013.01); *G09G 3/3696* (2013.01); *G09G 5/02* (2013.01); *G09G 2300/08* (2013.01); *G09G 2310/0213* (2013.01); *G09G 2330/021* (2013.01); *G09G 2330/028* (2013.01); *G09G 2360/08* (2013.01)

(58) Field of Classification Search

CPC ..... G09G 1/005; G09G 2300/0473; G09G 2330/021; G09G 2330/022; G09G 2310/0213; G09G 2330/00; G09G 3/3696

USPC ..... 345/211–213, 691

See application file for complete search history.

(56) References Cited

U.S. PATENT DOCUMENTS

| | | | | |
|---|---|---|---|---|
| 5,615,376 | A * | 3/1997 | Ranganathan | 713/322 |
| 7,417,613 | B2 | 8/2008 | Koyama | |
| 2003/0071778 | A1 * | 4/2003 | Lee et al. | 345/98 |
| 2003/0179221 | A1 * | 9/2003 | Nitta et al. | 345/690 |
| 2004/0095340 | A1 * | 5/2004 | Nakamura | 345/204 |

(Continued)

FOREIGN PATENT DOCUMENTS

| | | | |
|---|---|---|---|
| EP | 1612763 | A2 | 1/2006 |
| JP | 10-010489 | A | 1/1998 |

(Continued)

OTHER PUBLICATIONS

European Search Report for EP13175245 dated Feb. 28, 2014.

*Primary Examiner* — Premal Patel
(74) *Attorney, Agent, or Firm* — Innovation Counsel LLP

(57) ABSTRACT

A display device includes a display panel including a gate line, a data line, and a pixel connected to the gate line and the data line, a data driver connected to the data line, a gate driver connected to the gate line, and a signal controller controlling the data driver and the gate driver, wherein a circuits powering power source voltage that is normally used for driving the data driver is selectively not applied during a new-image blanking time when the signal controller is not supplying image data to the data driver.

68 Claims, 15 Drawing Sheets

(56) References Cited

U.S. PATENT DOCUMENTS

| | | | | |
|---|---|---|---|---|
| 2005/0057468 | A1* | 3/2005 | Yamamoto et al. | 345/87 |
| 2006/0114191 | A1* | 6/2006 | Choi | 345/76 |
| 2008/0204388 | A1* | 8/2008 | Lee et al. | 345/87 |
| 2009/0174646 | A1* | 7/2009 | Lim | 345/100 |
| 2010/0123727 | A1 | 5/2010 | Kwa et al. | |
| 2010/0164962 | A1 | 7/2010 | Sakariya | |
| 2011/0057914 | A1* | 3/2011 | Nam | 345/211 |
| 2012/0133635 | A1* | 5/2012 | Ji et al. | 345/212 |
| 2013/0038639 | A1 | 2/2013 | Han et al. | |
| 2013/0208030 | A1* | 8/2013 | Sarrasin | 345/691 |

FOREIGN PATENT DOCUMENTS

| | | | |
|---|---|---|---|
| JP | 2002-169137 | | 6/2002 |
| JP | 3766926 | | 2/2006 |
| JP | 2007-075173 | | 3/2007 |
| KP | 101079289 | B1 | 11/2011 |
| KR | 10-2004-0102918 | A | 12/2004 |
| KR | 10-0640750 | B1 | 10/2006 |
| KR | 10-2011-0092993 | A | 8/2011 |
| KR | 10-2012-0008149 | A | 1/2012 |
| KR | 1020130027226 | A | 3/2013 |

* cited by examiner

DISPLAY DEVICE AND DRIVING METHOD THEREOF

CROSS-REFERENCE TO RELATED APPLICATION

This application claims priority to and the benefit of Korean Patent Application No. 10-2012-0144600 filed in the Korean Intellectual Property Office on Dec. 12, 2012, the entire contents of which application are incorporated herein by reference.

BACKGROUND (a) Technical Field

The present disclosure of invention relates to a display device and a driving method thereof. More particularly, the present disclosure relates to a display device with reduced power consumption and a driving method thereof.

(b) Description of Related Technology

A computer monitor, a television, a mobile phone, and the like that are widely used as image display devices. Examples of such display devices include ones that operate with a cathode ray tube, a liquid crystal panel, and a plasma panel.

So-called, flat or curved panel display devices typically include a display panel and a signal controller operatively coupled to the panel. The signal controller generates one or more control signals to control the driving of the display panel and it also transmits an image data to the display panel in synchronization with the one or more control signals, thereby driving the display panel to form a desired image.

The images displayed by the display panel may be categorized as still images and moving picture images. The display panel typically presents several frames per second, and if the image data of each frame is the same, a still image is displayed. On the other hand, if the image data of successive frames change, then typically a moving picture is displayed.

Conventionally, when a still image is to be displayed, the signal controller repeatedly receives the same image data from an external graphics processing unit in each of successive frames even though it is displaying a non-changing still image. Similarly, when a moving picture is to be displayed, the signal controller receives successively different frames of image data so as to display the corresponding moving picture. The repeated transmission of the same image data from the external graphics processing unit to the signal controller even when a still image is to be displayed causes the power consumption to be higher than need be.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

The present disclosure of invention provides a display device with reduced power consumption and a driving method thereof.

A display device according to an exemplary embodiment includes: a display panel including a gate line, a data line, and a pixel connected to the gate line and the data line; a data driver connected to the data line; a gate driver connected to the gate line; and a signal controller controlling the data driver and the gate driver, wherein a circuits powering power source voltage normally driving the data driver is selectively not applied during a new-image blanking time, the latter being when the signal controller does not apply new image data to the data driver.

The circuits powering power source voltage may be an analog circuits powering voltage that powers one or more analog circuits of the display device.

A monolithically integrated power management integrated circuit (PMIC) unit generating the power source voltage may be further included.

A gray voltage generator transmitting a gray voltage to the data driver may be further included, and the gray voltage generator may normally receive the analog circuits powering voltage, but may not receive the analog circuits powering voltage during the new-image blanking time.

The gray voltage generator may include a plurality of data storage banks including one storing a blank time power control (BPC) gray voltage output at the blank time, and the BPC gray voltage may be selectively output during the new-image blanking time.

The BPC gray voltage may be a 0 V voltage.

A DC-DC unit applying a common voltage to the display panel may be further included.

The DC-DC unit may normally receive the analog circuits powering voltage, but may not receive the analog power source voltage during the blank time.

The DC-DC unit may normally generate at least one of a gate-on voltage, a gate-off voltage, and the common voltage.

The DC-DC unit may generate a gate-off voltage and a common voltage, and a DC-DC unit generating the gate-off voltage and a DC-DC unit generating the common voltage may be respectively formed.

The data driver, the gray voltage generator, and the DC-DC unit may normally receive the analog circuits powering voltage, the data driver and the gray voltage generator may not receive the analog power source voltage during the blank time, and the DC-DC unit may continue to receive the analog power source voltage during the blank time.

The data driver may include an output buffer unit, a digital-analog converter, a latch unit, and a shift register, and the output buffer unit and the digital-analog converter may normally receive the analog circuits powering voltage, but may not receive the analog circuits powering voltage during the blank time.

The PMIC unit may further normally generate a gate-on voltage or a common voltage as well as the power source voltage.

The power source voltage may also include a digital circuits powering voltage.

The digital circuits powering voltage may also be normally applied to the data driver, and at least one of the analog circuits powering voltage and the digital circuits powering voltage may selectively not be applied to the data driver during the new-image blanking time.

The data driver may include an output buffer unit, a digital-analog converter, a latch unit, and a shift register, and the output buffer unit and the digital-analog converter may normally receive the analog circuits powering voltage, but may not receive the analog circuits powering voltage during the blank time.

The latch unit and the shift register may normally receive the digital circuits powering voltage, but may selectively not receive the digital circuits powering voltage during the blank time.

A gray voltage generator transmitting a gray voltage to the data driver may be further included, and the gray voltage generator may normally receive the digital circuits powering voltage and the analog circuits powering voltage, but may not receive at least one of the digital power source voltage and the analog power source voltage during the blank time.

The digital circuits powering voltage may be firstly applied, the analog power circuits powering may be applied thereafter, after a predetermined time, and next, the analog circuits powering voltage may be selectively firstly blocked before the digital circuits powering voltage is selectively blocked.

The time when the analog power source voltage is not applied may be the new-image blanking time.

The power source voltage may be a digital circuits powering voltage.

The data driver may include an output buffer unit, a digital-analog converter, a latch unit, and a shift register, and the latch unit and the shift register may normally receive the digital circuits powering voltage, but may selectively not receive the digital circuits powering voltage during the new-image blanking time.

A gray voltage generator transmitting a gray voltage to the data driver may be further included, and the gray voltage generator may normally receive the digital circuits powering voltage, but may selectively not receive the digital circuits powering voltage during the blank time.

A display device according to an exemplary embodiment includes: a display panel including a gate line, a data line, and a pixel connected to the gate line and the data line; a data driver connected to the data line; a gate driver connected to the gate line; and a signal controller controlling the data driver and the gate driver, wherein a clock signal is selectively not applied to the data driver during a new-image blanking time, the latter being when the signal controller does not apply image data to the data driver.

The signal controller may include a phase lock loop (PLL) unit generating the clock signal and an output terminal outputting the clock signal, the data driver may include a receiving terminal receiving the clock signal, and the PLL unit may be controlled by an enable signal of the signal controller such that the clock signal may be selectively not generated during the new-image blanking time.

The signal controller may include an output terminal outputting the clock signal, the data driver may include a receiving terminal normally receiving the clock signal, and the output terminal may selectively not output the clock signal during the new-image blanking time by control of the enable signal of the signal controller.

The output terminal and the receiving terminal may be connected as a pair of wires, and one of the pair of wires may be selectively floated when the clock signal is selectively not output.

The signal controller may not apply the power source voltage driving the data driver during the blank time when the image data is not applied to the data driver.

The power source voltage may be an analog power source voltage.

A gray voltage generator transmitting a gray voltage to the data driver may be further included, and the gray voltage generator may normally receive the analog power source voltage, but may selectively not receive the analog power source voltage during the blank time.

A DC-DC unit applying a common voltage to the display panel may be further included.

The DC-DC unit may normally receive the analog power source voltage, but may selectively not receive the analog power source voltage during the blank time.

The DC-DC unit may generate at least one of a gate-on voltage, a gate-off voltage, and the common voltage.

The data driver, the gray voltage generator, and the DC-DC unit may normally receive the analog power source voltage, the data driver and the gray voltage generator may not receive the analog power source voltage during the blank time, and the DC-DC unit may continue to receive the analog power source voltage during the blank time.

The data driver may include an output buffer unit, a digital-analog converter, a latch unit, and a shift register, and the output buffer unit and the digital-analog converter may normally receive the analog power source voltage, but may selectively not receive the analog power source voltage during the new-image blanking time.

A method of driving a display device including a display panel including a gate line, a data line, and a pixel connected to the gate line and the data line, a data driver connected to the data line, a gate driver connected to the gate line, and a signal controller controlling the data driver and the gate driver, where the method according to an exemplary embodiment includes selectively not applying a power source voltage to the data driver during a new-image blanking time when the signal controller does not apply image data to the data driver.

The power source voltage may be an analog power source voltage.

The display device further may include a power management integrated circuit (PMIC) unit generating a power source voltage.

The display device may further include a gray voltage generator normally transmitting the gray voltage, and the signal controller may selectively not apply the analog power source voltage to the gray voltage generator that otherwise normally receives the analog power source voltage during the blank time.

The gray voltage generator may include a memory bank storing a blank time power control (BPC) gray voltage output at the blank time, and the gray voltage generator may output the BPC gray voltage during the blank time.

The BPC gray voltage may have a 0 V voltage.

The display device may further include a DC-DC unit applying a common voltage to the display panel.

The signal controller may not apply the analog power source voltage to the DC-DC unit that normally receives the analog power source voltage, during the blank time.

The method may further include generating at least one among a gate-on voltage, a gate-off voltage, and the common voltage by the DC-DC unit.

The method may further include generating a gate-off voltage and a common voltage by the DC-DC unit, and a DC-DC unit generating the gate-off voltage and a DC-DC unit generating the common voltage may be included in the DC-DC unit.

For the data driver, the gray voltage generator, and the DC-DC unit receiving the analog power source voltage, the signal controller may control the data driver and the gray voltage generator to selectively not be applied with the analog power source voltage during the new-image blanking time, and the DC-DC unit to continue to be applied with the analog power source voltage during the blank time.

The data driver may include an output buffer unit, a digital-analog converter, a latch unit, and a shift register, and the signal controller may control the output buffer unit and the digital-analog converter receiving the analog power source voltage to be applied with the analog power source voltage during the blank time.

The PMIC unit may further generate the gate-on voltage or the common voltage as well as the power source voltage.

The power source voltage may also include a digital power source voltage.

The signal controller may control the data driver receiving the digital power source voltage to selectively not be applied with at least one of the analog power source voltage and the digital power source voltage during the blank time.

The data driver may include an output buffer unit, a digital-analog converter, a latch unit, and a shift register, and the signal controller may control the output buffer unit and the digital-analog converter normally receiving the analog power source voltage to selectively not be applied with the analog power source voltage during the blank time.

The signal controller may control the latch unit and the shift register normally receiving the digital power source voltage to selectively not be applied with the digital power source voltage during the blank time.

The display device may further include a gray voltage generator transmitting a gray voltage to the data driver, and the signal controller may control the gray voltage generator receiving the analog power source voltage and the digital power source voltage to not be applied with the digital power source voltage or the analog power source voltage during the blank time.

The digital power source voltage may be firstly applied, the analog power source voltage may be applied after a predetermined time after the digital power source voltage is firstly applied, and next, the analog power source voltage may be selectively firstly blocked before the digital power source voltage is selectively blocked.

The time when the analog power source voltage is not applied may be the blank time.

The power source voltage may be a digital power source voltage.

The data driver may include an output buffer unit, a digital-analog converter, a latch unit, and a shift register, and the signal controller may control the latch unit and the shift register normally receiving the digital power source voltage to continue to be applied with the digital power source voltage during the blank time.

The display device may further include a gray voltage generator transmitting a gray voltage to the data driver, and the signal controller may control the gray voltage generator normally receiving the digital power source voltage to continue to be applied with the digital power source voltage during the blank time.

A method of driving a display device a display panel including a gate line, a data line, and a pixel connected to the gate line and the data line, a data driver connected to the data line, a gate driver connected to the gate line, and a signal controller controlling the data driver and the gate driver according to an exemplary embodiment includes selectively not applying a clock signal to the data driver during a new-image blanking time when the signal controller is not applying new image data to the data driver.

The signal controller may include a phase lock loop (PLL) unit normally generating the clock signal and an output terminal outputting the clock signal, the data driver may include a receiving terminal receiving the clock signal, and the signal controller may control the PLL unit by means of an enable signal to selectively not generate the clock signal during the new-image blanking time.

The signal controller may include an output terminal normally outputting the clock signal, the data driver may include a receiving terminal normally receiving the clock signal, and the signal controller may control the output terminal by means of an enable signal to selectively not output the clock signal during the blank time.

The output terminal and the receiving terminal may be connected as a pair of wires, and the signal controller may float one of the pair of wires for the clock signal to not be output.

The signal controller may selectively not apply the power source voltage driving the data driver during the blank time when the image data is not being applied to the data driver.

The power source voltage may be an analog power source voltage.

The display device may further include a gray voltage generator normally transmitting a gray voltage to the data driver, and the signal controller may control the gray voltage generator normally receiving the analog power source voltage to continue to be applied with the analog power source voltage during the blank time.

The display device may further include a DC-DC unit applying a common voltage to the display panel.

The signal controller may control the DC-DC unit receiving the analog power source voltage to not be applied with the analog power source voltage during the blank time.

The DC-DC unit may generate at least one of the gate-on voltage, the gate-off voltage, and the common voltage.

For the data driver, the gray voltage generator, and the DC-DC unit receiving the analog power source voltage, the signal controller may control the data driver and the gray voltage generator to selectively not be applied with the analog power source voltage during the blank time, and the DC-DC unit to continue to be applied with the analog power source voltage during the blank time.

The data driver may include an output buffer unit, a digital-analog converter, a latch unit, and a shift register, and the signal controller may control the output buffer unit and the digital-analog converter normally receiving the analog power source voltage to selectively not be applied with the analog power source voltage during the blank time.

As described above, at least one of a circuits powering driving voltage or a clock signal is blocked in the display device during the new-image blanking time for the corresponding driver to not be normally operated during the new-image blanking time thereby reducing the power consumption of the display device.

DETAILED DESCRIPTION

Figure 1:
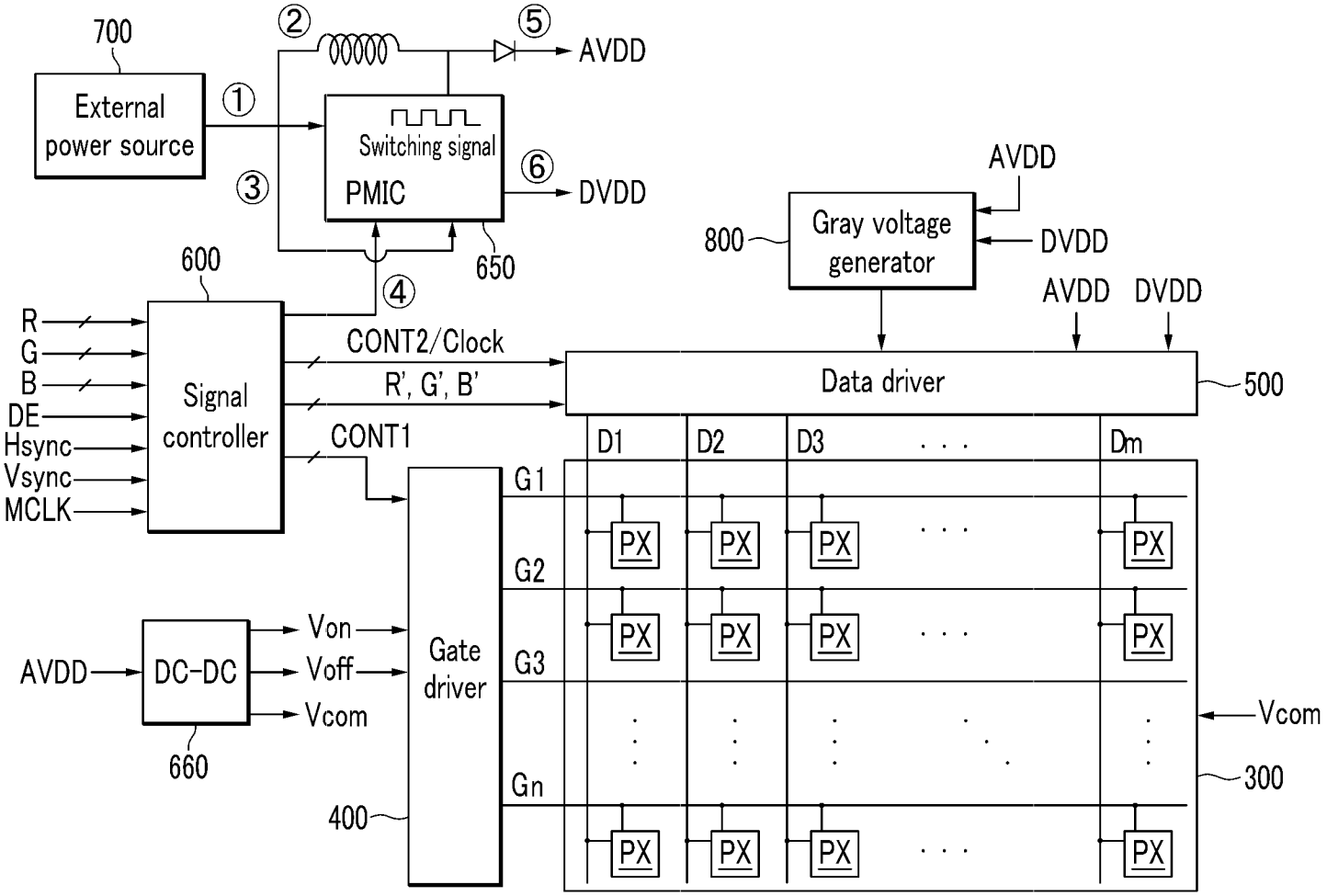
FIG. 1 is a block diagram of a display device according to an exemplary embodiment of the present disclosure of invention.

The present disclosure of invention will be described more fully hereinafter with reference to the accompanying drawings, in which exemplary embodiments are shown. As those skilled in the art would realize in view of the present disclosure, the described embodiments may be modified in various different ways, all without departing from the spirit or scope of the present teachings.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Now, a display device according to an exemplary embodiment will be described with reference to FIG. 1.

FIG. 1 is a block diagram of a display device according to an exemplary embodiment.

As shown in FIG. 1, a display device according to an exemplary embodiment includes a display panel 300 configured for displaying an image (including a moving picture image) and it further includes a data driver circuit 500 and a gate driver circuit 400 each coupled for respectively driving corresponding data lines and gate lines of the display panel 300. Also, a signal controller 600 is provided for controlling the data driver 500 and the gate driver 400 as well as for controlling a gray voltage generator 800 where the latter (800) generates voltages required by the data driver circuit 500. Moreover, the signal controller 600 is configured for controlling a DC-to-DC power conversion unit 660 and a pulsed switched power unit 650 (also referred to herein as a PMIC unit 650). The PMIC unit 650 receives power from an external power sourcing unit 700.

Next, each portion of FIG. 1 will be described in more detail. The display panel 300 will be firstly described.

The display panel 300 includes a plurality of gate lines G1-Gn and a plurality of data lines D1-Dm, wherein the plurality of gate lines G1-Gn extend in a transverse direction and the plurality of data lines D1-Dm intersect the plurality of gate lines G1-Gn while extending in a longitudinal direction.

Respective ones of the gate lines G1-Gn and respective ones of the data lines D1-Dm are connected to corresponding ones of repeated pixel units. Each pixel unit includes at least one respective switching element Q (not shown in FIG. 1, but can be a thin film semconductive transistor or TFT having a gate and a source electrode) respectively connected to a corresponding one of the gate lines of G1-Gn and a corresponding one of the data lines D1-Dm. The switching element Q may include an output terminal (e.g., drain electrode) connected to a corresponding pixel electrode of the pixel unit. In the case of the liquid crystal display (LCD), the pixel electrode defines one plate of a liquid crystal capacitor while the opposed plate is defined by a so-called, common electrode. In the case of an organic light emitting device (OLEDD), the drain electrode provides a capacitively stored control signal to a driving transistor where the latter controls a magnitude of current delivered to one terminal of an organic light emitting diode (OLED). The function of the output of the switching element Q may be different depending on the kind of display device involved (e.g., plasma, LCD, OLED, electorphoretic, surface wetting electrolyte, etc.).

Hereafter, the display panel 300 will be described while focusing on a liquid crystal display (LCD) type of panel. However, the display panel 300 applied to the present invention may be various display panels such as the above mentioned organic light emitting panel, an electrophoretic display panel, and a plasma display panel, as well as the liquid crystal panel.

The display panel 300 may be used to display either a still image or a moving picture. If a plurality of continuous frames having the same image data are formed, a corresponding still image may be seen by the user. On the other hand, if they have different image data, a corresponding moving picture may be seen by the user of the display device. Also, the signal controller 600 may output a still image indicator signal as part of its output control signals and may operate at a lower-than-normal frequency for displaying generic images when displaying the still image where the lower than normal frequency corresponds to a reduced power consumption state of the signal controller 600 as compared to that when displaying motion pictures.

The signal controller 600 appropriately processes image signals R, G, and B input from the outside to be suitable for operating conditions of the liquid crystal panel 300 and in response to correspondingly input control signals input from the outside, for example, a vertical synchronization signal Vsync, a horizontal synchronizing signal Hsync, a main clock signal MCLK, and a data enable signal DE, and then the signal controller 600 generates and outputs corresponding image data R', G', and B', a gate control signal CONT1, a data control signal CONT2, and a clock signal Clock.

The gate control signal CONT1 includes a scanning start signal STV (referred to as an "STV signal") instructing an output start of a gate-on pulse (a high period of a gate signal GS) and a gate clock signal CPV (referred to as a "CPV signal") instructing an output timing of sequential gate-on pulses.

The data control signal CONT2 further includes a horizontal synchronization start signal STH instructing an input start of the image data DAT and a load signal TP indicating a timing for applying corresponding data voltages to the data lines D1-Dm.

A plurality of gate lines G1-Gn of the display panel 300 are connected to the gate driver 400, and the gate driver 400 alternately applies the gate-on voltage Von and the gate-off voltage Voff to the gate lines G1-Gn according to the gate control signal CONT1 received from the signal controller 600. In the exemplary embodiment of FIG. 1, the gate-on voltage Von and the gate-off voltage Voff output from the gate driver 400 use reference voltages (Von. Voff) input from the DC-DC unit 660. However, according to an alternative embodiment, it may be that only one voltage of the gate-on voltage Von and the gate-off voltage Voff is applied from the DC-DC unit 660, and the other voltage is generated inside the gate driver 400 for example, as a function of the applied one voltage from the DC-DC unit 660.

A plurality of data lines D1-Dm of the display panel 300 are connected to the data driver 500, and the data driver 500 receives the data control signal CONT2 and the image data DAT from the signal controller 600. The data driver 500 converts the digital image data signal DAT into corresponding analog data voltages by using reference gray scale voltages generated in the gray voltage generator 800 and transmits the corresponding analog data voltages to respective one of the data lines D1-Dm.

In the exemplary embodiment of FIG. 1, the output voltages generated respectively by the data driver 500, by the gray voltage generator 800, and by the DC-DC unit 660 are functions of at least one of an AVDD voltage and/or a DVDD voltage output as a power source voltage from a power source means (e.g., 650 and 700) described herein. More specifically, here, the AVDD voltage may be an analog power source voltage used by analog signal outputting units such as 500, 800 of the exemplary embodiment of FIG. 1 and the DVDD voltage may be a digital power source voltage used by digital signal processing units such as 500, 800 of the exemplary embodiment of FIG. 1.

Yet more specifically, in the exemplary embodiment of FIG. 1, the AVDD power source voltage and/or the DVDD power source voltage are generated from one or more external power source signals provided by the external power unit 700 which latter power source signals are converted for example under control of the power-managing PMIC unit 650 of FIG. 1.

The power-managing PMIC unit 650 may be formed of a monolithically integrated circuit (IC) where the latter has a plurality of input terminals and a plurality of output terminals. In one embodiment, the PMIC unit 650 receives a master external power source voltage from the external power unit 700 by way of input terminal ①, and receives a power-management control signal from the signal controller 600 by way of input terminal ④. The PMIC unit 650 includes switched inductor circuitry for cooperating with and external inductor (L) and generating the DVDD voltage and the AVDD voltage based on the external power source voltage according to the control signal (①) provided by the signal controller 600.

Referring to input terminals ② and ⑤ of FIG. 1, in the exemplary PMIC unit 650, the AVDD voltage is generated through the switching signal generated based on the external power source voltage and an inductor and a diode. Further, referring to input terminals ③ and ⑥ of FIG. 1, in the exemplary PMIC unit 650, the DVDD voltage is generated by converting the external power source voltage to desired levels using switched inductor technology. (More specifically and in one embodiment, a first pulse of electrical current is caused to flow through the illustrated external inductor (L) and is then cut off. In response the external inductor (L) produces a second pulse of electrical current that is output through the diode. An external capacitor (not shown) integrates the second pulse of electrical current to produce a corresponding voltage level as the AVDD level. Typically, the AVDD level is greater than the external power source voltage and is greater than the DVDD level.

In FIG. 1, terminal ① is a case that the external power source voltage (e.g., 5 Volts) is input from the external power unit 700 to the PMIC unit 650 to generate the AVDD and DVDD voltages together, while terminal ② is a case that the external power source is also input from the external power unit 700 to the external inductor (L) and to the PMIC unit 650 to generate the AVDD voltage, and terminal ③ is a case that the external power source voltage is input from the external power unit 700 to the PMIC unit 650 to generate the DVDD voltage.

According to different exemplary embodiments, terminals ①, ②, and ③ may all be used, and according to at least some others not all of the terminals are used or included.

In FIG. 1, route ④ shows a path through which the control signal is transmitted from the signal controller 600 to the PMIC unit 650, route ⑤ is a path through which the AVDD voltage is output in the PMIC unit 650, and route ⑥ shows a path through which the DVDD voltage is output in the PMIC unit 650.

The AVDD voltage output from the PMIC unit 650 is applied to the data driver 500, the gray voltage generator 800, and the DC-DC unit 660, while the DVDD voltage is applied to the data driver 500 and the gray voltage generator 800 for the operation of each portion.

The DC-DC converter unit 660 receives the AVDD voltage from the PMIC unit 650 and uses the received level of the AVDD voltage to correspondingly generate the gate-on voltage Von, the gate-off voltage Voff, and a common voltage Vcom through a DC-to-DC conversion process. The gate-on voltage Von and the gate-off voltage Voff are transmitted to the gate driver 400. The common voltage Vcom is transmitted to a common electrode (not shown) of the display panel 300.

In the display device according to an exemplary embodiment, at least one drivers 400 and 500 of the display device is not operated during a new-image blanking time within which new image data for displaying a new image is not transmitted from the signal controller 600 to the panel drivers to thereby reduce power consumption. According to the present disclosure, at least one of the panel drivers (e.g., 400, 500) driver is not operated at normal full power during the new-image blanking time so as to further reduce power consumption. In one embodiment, the circuit units that are de-powered during the new-image blanking time comprise one or more of the PMIC unit 650, the gray voltage generator 800, the data driver 500, the DC-DC unit 660, and the gate driver 400.

In the exemplary embodiment of FIG. 1, at least one of routes ① to ⑥ is blocked during the new-image blanking time so as to not generate the AVDD voltage or the DVDD voltage and such that each panel driver that is operated by the AVDD voltage or the DVDD voltage is also not be operated, thereby reducing power consumption.

That is, in one embodiment, power-inputting route ① is selectively blocked during the new-image blanking time such that the external power to not be applied during the new-image blanking time from the external power unit 700 to the PMIC unit 650, where the PMIC unit 650 is configured such that the PMIC unit 650 is not operated (e.g., does not energize the inductor (L) during the new-image blanking time. As a result, the levels of the AVDD voltage and the DVDD voltage that should be normally generated by the PMIC unit 650 are not generated and instead the AVDD voltage and the DVDD voltage fall below respective and predefined threshold levels.

Meanwhile, the inductor feeding route ② is selectively blocked during the new-image blanking time such that the external power of the external power unit 700 not applied to the inductor (L) feeding route ② and thus where the normal level of the AVDD voltage which is normally generated by the PMIC unit 650 is not generated and the AVDD voltage falls below its respective predetermined minimal threshold level. One or more of the drive circuits that operate when they receive the normal level of the AVDD voltage are configured to depower themselves when the AVDD voltage falls below its respective predetermined minimal threshold level. As a result, the one or more drivers (e.g., the data driver 500, the gray voltage generator 800, and the DC-DC unit 660) receiving the sub-threshold AVDD voltage level automatically depower themselves (e.g., temporarily disconnect from ground) and are thus not operated during the new-image blanking time.

Meanwhile, a DVDD supply route ③ by way of which power is inputted to the DVDD generating portion of the PMIC unit 650 is selectively blocked during the new-image blanking time such that the external power normally applied from the external power unit 700 to the PMIC unit 650 for generating the normal DVDD level is not applied to the DVDD supply route ③ and thus a sub-threshold DVDD voltage is generated by the PMIC unit 650 rather than the normally generated DVDD voltage level. One or more of the drive circuits that operate at full power when they receive the normal level of the DVDD voltage are configured to depower themselves when the DVDD voltage falls below its respective predetermined minimal threshold level. As a result, the driver circuits (e.g., the data driver 500 and the gray voltage generator 800) that receive the DVDD voltage are not operated at respective full power consumption levels during the new-image blanking time.

Meanwhile, the control providing route ④ is selectively blocked during the new-image blanking time such that the control signal that is normally transmitted from the signal controller 600 to the PMIC unit 650 for controlling the generating of the normal AVDD voltage and the normal DVDD voltage when moving pictures are displayed is deasserted. As a result, at this time, the control signal is not be applied from the signal controller 600 to the PMIC unit 650 through route ④ and in response, the PMIC unit 650 stops generating one or both of the normal AVDD voltage and the normal DVDD voltage. In an alternate embodiment, a control signal to not generate the normal AVDD voltage and/or the normal DVDD voltage is applied during the new-image blanking time. Accordingly, at least one of the normal AVDD voltage and the normal DVDD voltage is not be generated (where normal is the respective level normally used when moving pictures are displayed).

Meanwhile, voltage outputting route ⑤ and/or route ⑥ are selectively blocked during the new-image blanking time such that the normal AVDD voltage and/or the normal DVDD voltage are not output. That is, in the PMIC unit 650, the output terminal is blocked for the AVDD voltage to not be output by way of route ⑤ or the output terminal is blocked for DVDD voltage to not be output by way of route ⑥.

As described above, by one or more of the mentioned techniques, the normal power source voltages are not applied and instead respective sub-threshold voltages or currents are applied respectively to the data driver 500, the gray voltage generator 800, and the DC-DC unit 660 by not generating the normal AVDD voltage and/or the normal DVDD voltage. Also, the gate driver 400 may be depowered by not receiving the normal gate-on voltage Von and/or the normal gate-off voltage Voff from the DC-DC unit 660 but rather subthreshold levels. As a result, the display device is not operated at normal power consumption levels during the new-image blanking time such that the power consumption may be reduced.

Figure 3:
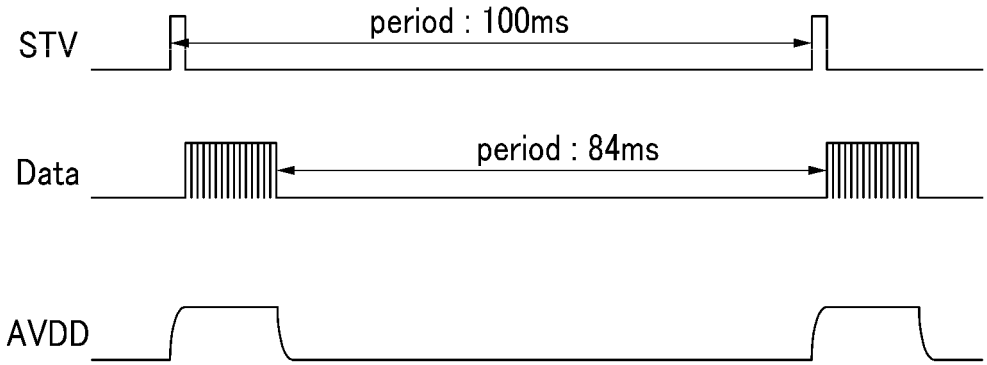
FIG. 3 is a signal application timing diagram of a display device according to an exemplary embodiment.

Next, referring to FIG. 3, the new-image blanking time may have a duration corresponding to one or both of a horizontal blanking time (1H) and a vertical blanking time (1V). In the illustrated example, and the duration of the new-image blanking time corresponds to the vertical blanking time (1V, e.g., the new-image blanking time has a duration slightly less than the period between STV pulses).

In FIG. 1, selective blocking of one or more of signal routes ① to ⑥ are mainly described, however the exemplary embodiments are not limited thereto.

Also, to block one among routes ① to ⑥, a switch (e.g., a pass transistor) or a MUX may be used in the corresponding route.

This aspect will be described with reference to FIG. 2.

Figure 2:
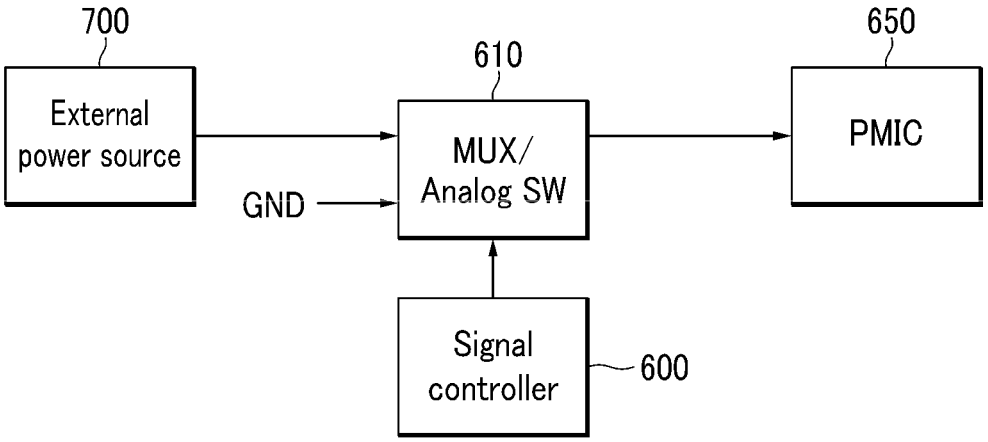
FIG. 2 is a block diagram of a structure blocking a signal in a display device according to an exemplary embodiment.

FIG. 2 is a block diagram of a structure configured for selectively blocking a power-enabling signal in a display device according to an exemplary embodiment.

In the exemplary embodiment of FIG. 2, an analog multiplexor (MUX) or alternatively an analog signal switch 610 is installed between the external power unit 700 and the PMIC unit 650 so as to selectively supply either the ground level GND or a power-enabling signal supplied from the external power unit 700 for use by the PMIC unit 650 where the signal controller 600 controls the switch state of the MUX or analog signal switch 610. That is, the MUX or switch 610 selectively transmits or blocks the external power signal provided from the external power unit 700 to the PMIC unit 650 in accordance with the control signal supplied from the signal controller 600. The MUX or switch 610 receives the ground voltage GND, and may transmit one of the external power and the ground voltage GND to the PMIC unit 650.

The exemplary embodiment of FIG. 2 is a case in which the MUX or switch is installed in signal supplying route ① of FIG. 1. Alternatively, the selective signal blocking operation may be performed by installing the MUX or switch on routes ② to ⑥ of FIG. 1.

Among the MUX or the switch, the MUX performs the blocking by operation of the circuit as a digitally-controlled method, whereas the switch may perform the selective blocking by opening a connection of a wire and as an analog-actuated method.

Next, a waveform diagram in the display device according to the exemplary embodiment of FIG. 1 will be described with reference to FIG. 3.

FIG. 3 is a signal application timing diagram of a display device according to an exemplary embodiment.

As shown in FIG. 3, in synchronization with a time duration of about 100 ms that occurs immediately before a next scanning start signal STV is applied following the application of a first scanning start signal STV is applied, there is a second duration (new-image blanking period) of about 84 ms during which no data signal Data is transmitted for representing a next and new image to be displayed. During this new-image blanking time (e.g., of approximate duration of 84 milliseconds), at least one among the drivers mentioned above is not operated. FIG. 3 is an exemplary embodiment in which the normal-operation level of the AVDD voltage is not applied among the power source voltages and instead the AVDD line carries a voltage level that is below a predetermined threshold level.

That is, in FIG. 3, during the time that the data signal Data for new image information is applied, the AVDD voltage is also generated such that each driver (e.g., the gate driver 400 and the data driver 500) receives the normal AVDD voltage level and the corresponding driver can therefore be normally operated. However, when the normal level AVDD voltage is not generated during the new-image blanking time, and instead the sub-threshold level is present on the AVDD-providing lines, the corresponding drivers (e.g., the gate driver 400 and the data driver 500) responsively switch themselves into non-operational or low power modes and are thus not normally operated. As a result, the power consumption may be reduced.

Next, a structure and an operation of a grayscale voltages generator 800 according to an exemplary embodiment will be described with reference to FIG. 4.

Figure 4:
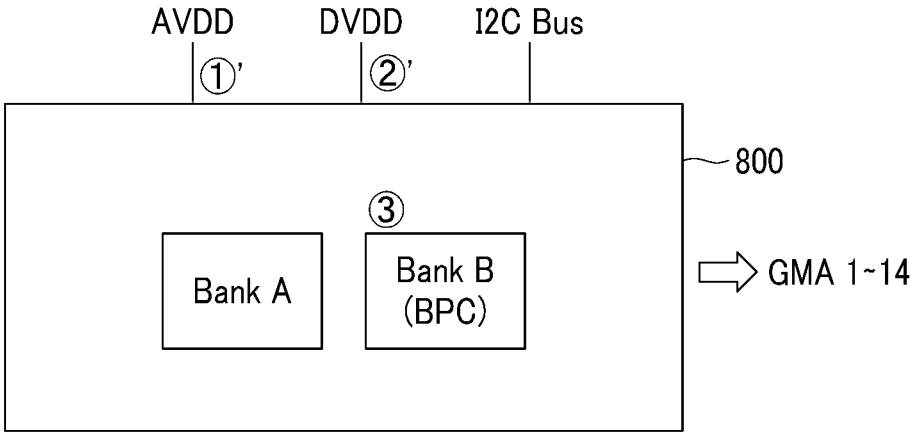
FIG. 4 is a block diagram of a gray voltage generator according to an exemplary embodiment.

FIG. 4 is a block diagram of a grayscale voltages generator according to an exemplary embodiment.

As described in FIG. 1, in a first case the grayscale voltages generator 800 shown in FIG. 4 receives the normal AVDD voltage and the normal DVDD voltage from the PMIC unit 650, and as a result the grayscale voltages generator 800 operates normally and produces corresponding grayscale reference voltages GMA1 through GMA14. On the other hand, in a second case where at least one voltage of these voltages is blocked during the new-image blanking time in order to reduce the power consumption, as is indicated in FIG. 4 by selectively blockable routes ① and ②, the grayscale voltages generator 800 is not normally operated and it does not produce corresponding grayscale reference voltages GMA1 through GMA14. That is, when route ① and route ② are applied with the normal AVDD voltage and the normal DVDD voltage from the PMIC unit 650, normal operation takes place; and when at least one of them is blocked during the new-image blanking time, the grayscale voltages generator 800 is not operated at a full (normal) power consuming level.

FIG. 4 is to be also understood as representing exemplary other embodiments in which the grayscale voltages generator 800 is selectively blocked form operating normally by different methods as well as the case of blocking the AVDD voltage or the DVDD voltage as described above.

In the indicated route ③ of FIG. 4, the gray voltage generator 800 has a first register bank BANK A as an inner register configured for storing first digital signals representing corresponding gray voltages GMA1-14 that are normally output. Moreover, in the exemplary embodiment of FIG. 4, the gray voltage generator 800 has a second register bank BANK B that is configured for storing second digital signals representing corresponding gray voltages GMA1-14 that are to be output when a powered-down mode is in effect. In one embodiment, the second bank B registers all stores a BPC gray voltage representing signal that corresponds to the voltages output during the new-image blanking time (where BPC stands for blank time power control). In one embodiment, the output voltage corresponding to the BPC gray voltage signal is 0 V. As a result, since the gray voltage generator 800 outputs the gray voltages GMA1-14 of 0 V during the new-image blanking time, the data voltages generated in and/or by the data driver 500 is 0 V thereby reducing the power consumption.

The respective gray voltage generator 800 of a corresponding exemplary embodiment may only output a normal operation blocking signal along only one of routes ①', ②', and ③ of FIG. 4 and/or among more than one of them.

Figure 5:
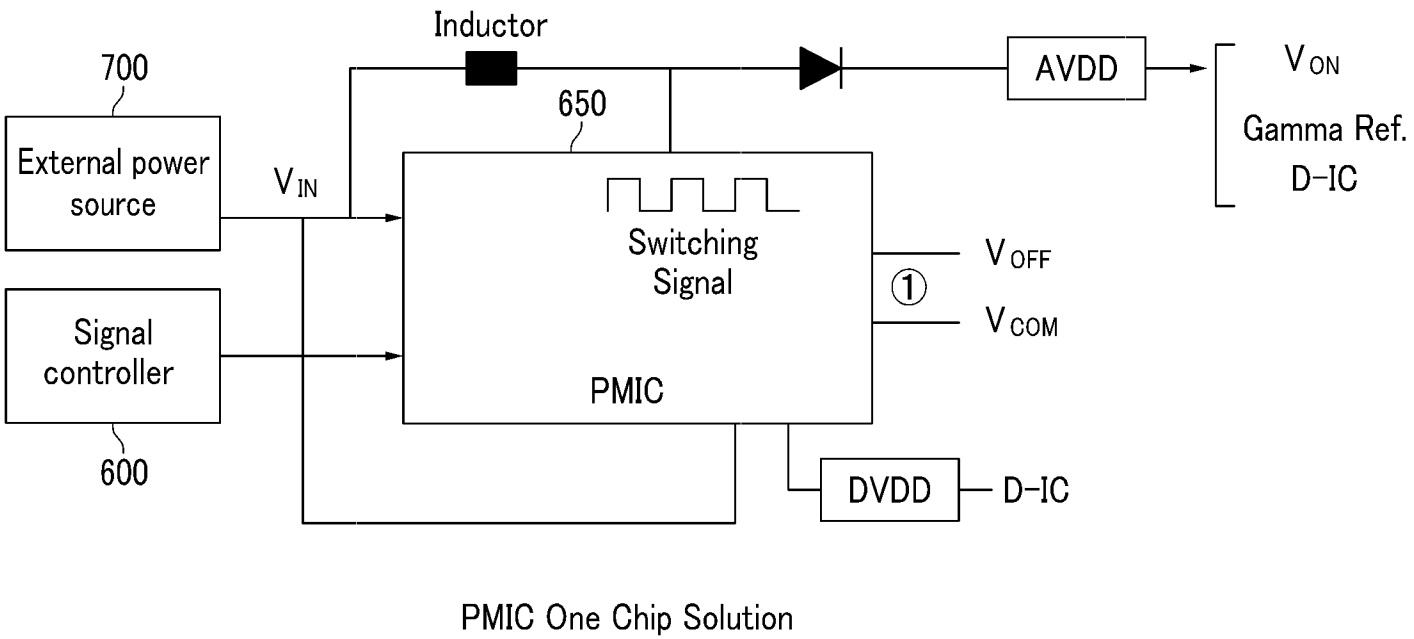
FIG. 5 is a block diagram of a power management integrated circuit (PMIC) unit according to another exemplary embodiment.

FIG. 5 shows a PMIC unit 650 according to another exemplary embodiment.

FIG. 5 is a block diagram of a PMIC unit according to another exemplary embodiment.

FIG. 5 shows an exemplary embodiment in which the gate-off voltage Voff and the common voltage Vcom that were shown in FIG. 1 as being generated in the DC-DC unit 660 as being instead generated by the PMIC unit 650, differently from the exemplary embodiment of FIG. 1.

FIG. 5 is an exemplary embodiment additionally including an IC constitution of the PMIC unit 650 from the exemplary embodiment of FIG. 1 to differently generate the gate-off voltage Voff and the common voltage Vcom.

Referring to route ① of FIG. 5, in the illustrated PMIC unit 650, the output terminal of the gate-off voltage Voff or the common voltage Vcom is selectively blocked during the blank time to correspondingly not output the normal gate-off voltage Voff or the normal common voltage Vcom, thereby reducing the power consumption of the circuit.

In FIG. 5, the to-Gamma Ref. connection represents that to the gray voltage generator 800, and D-IC connection represents that to the data driver 500.

In FIG. 1, to generate the normal gate-off voltage Voff or the normal common voltage Vcom, the external power unit 700, the PMIC unit 650, and the DC-DC unit 660 are required, however in FIG. 5, the exemplary embodiment generates the gate-off voltage Voff or the common voltage Vcom from the PMIC chip thereby simplifying (reducing the number of circuit components) the circuitry of FIG. 5.

Figure 6:
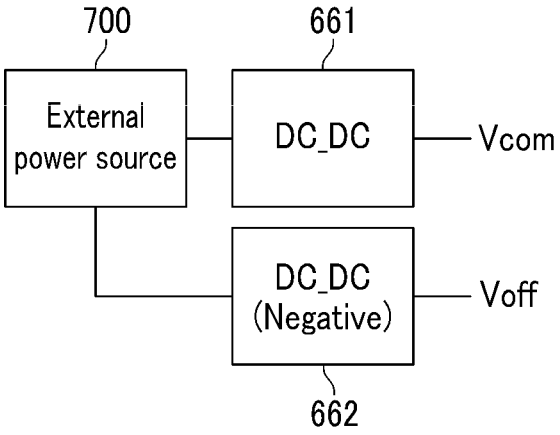
FIG. 6 is a block diagram of a DC-DC unit according to another exemplary embodiment.

FIG. 6 is a block diagram showing an alternative embodiment for a DC-DC converting unit according to another exemplary embodiment.

The DC-DC unit 660 according to the exemplary embodiment of FIG. 6 includes two separate DC-DC converter units 661 and 662, where the two DC-DC units 661 and 662 directly each receives the external power from the external power unit 700. At this time, the applied external powers are respectively DC-DC-converted to generate the normal common voltage Vcom and the normal gate-off voltage Voff.

Although not shown in the exemplary embodiment of FIG. 6, it is to be understood that selective MUX means or analog switch means are provided so that during the new-image blanking time the external power of the external power unit 700 is not applied to the DC-DC units 661 and 662. Accordingly, during the new-image blanking time, the power consumption of the DC-DC 661 and 662 units are reduced because the latter do not respectively output the normal common voltage Vcom or the normal gate-off voltage Voff.

Next, a monolithically integrated PMIC unit 650 and a peripheral circuit therefor will be described as well as a signal application timing diagram with reference to FIG. 7 and FIG. 8.

Figure 7:
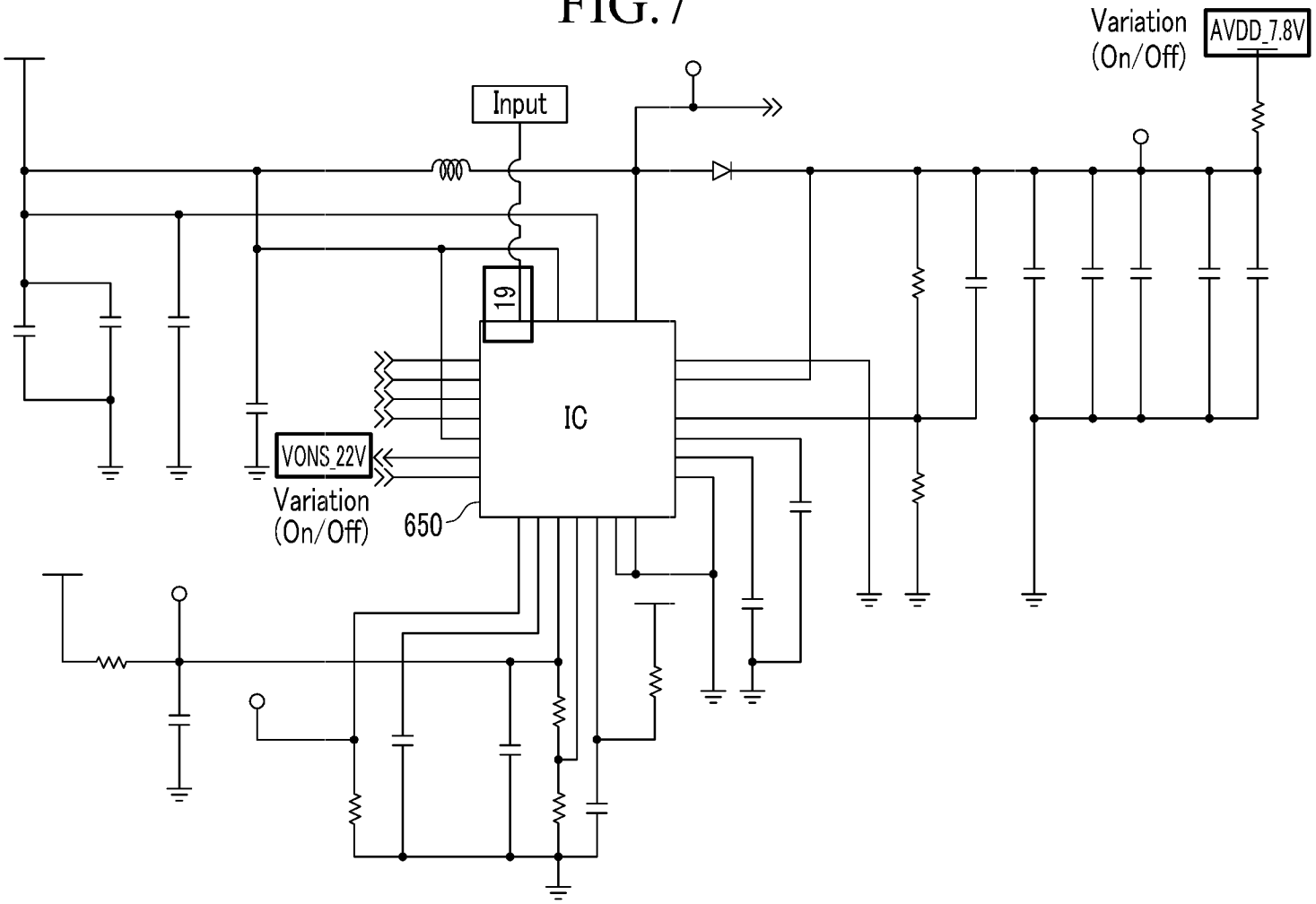
FIG. 7 is a view of a PMIC unit 650 and a peripheral circuit according to an exemplary embodiment.

FIG. 7 is a view of a PMIC unit 650 and a peripheral circuit according to an exemplary embodiment. FIG. 8 is a signal application timing diagram according to FIG. 7.

In FIG. 7, a chip used as the IC in the PMIC unit 650 is an RT9910A chip, and a peripheral circuit according thereto is provided.

The RT9910A IC chip has an enable input terminal (referring to BPC-EN pin 19 of FIG. 7) and a terminal (referred to as VONS_22 V in FIG. 7) configured for outputting the gate-on voltage Von. Also, the AVDD voltage is output (referred to as the AVDD_7.9 V pin in FIG. 7).

The signal controller 600 transmits the signal applied to the enable input terminal (referring to 19 of FIG. 7) of the IC chip to selectively control the PMIC unit 650, for example controlling it to not be normally operated during the new-image blanking time by using a corresponding Blanking Period Control (BPC) signal. As a result, in the exemplary embodiment using the PMIC unit 650 according to the exemplary embodiment of FIG. 7, the normal AVDD voltage and the normal gate-on voltage Von are not output during the new-image blanking time thereby reducing the overall power consumption of the device.

Figure 8:
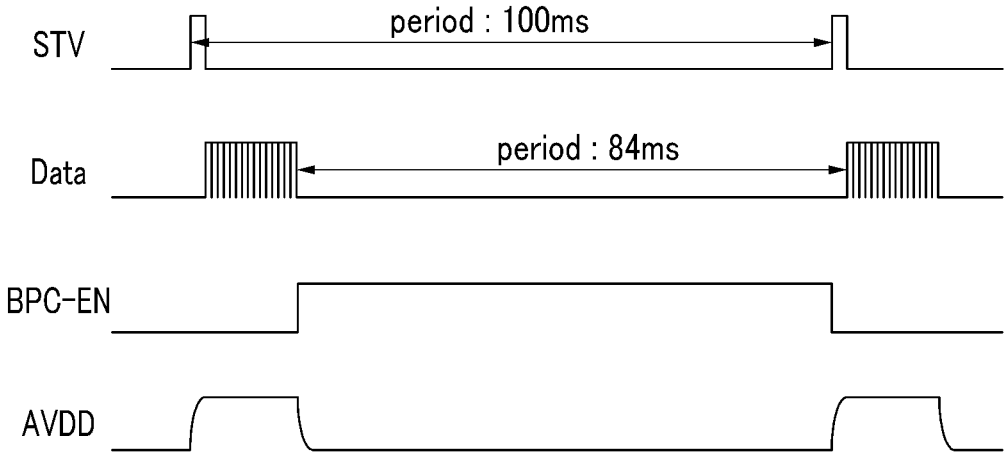
FIG. 8 is a signal application timing diagram according to FIG. 7.

In the display device including the PMIC unit 650 according to the exemplary embodiment of FIG. 7, a signal timing like that shown in FIG. 8 is provided.

In FIG. 8, the BPC/EN signal is applied from the signal controller 600 to the enable input terminal of the PMIC unit 650. The BPC/EN signal is at the logic high level when the new-image Blanking time Period (BP) is true and the PMIC unit 650 is not to be normally operated. The BPC/EN signal is at the logic low level when the normal operation of the PMIC unit 650 is to be enabled (/EN=0). In other words, when the BPC/EN signal has the low level, the PMIC unit 650 may be normally operated. In an alternate embodiment, the low versus high logic for the BPC/EN signal of FIG. 8 may be exchanged in which case it will be called the EN/BPC signal. That is, regardless of how the high level and the low level are assigned as operative modes of the BPC/EN signal, the BPC/EN signal may be used to selectively block or enable the normal operation of the PMIC unit 650, where the latter is blocked during the new-image blanking time.

As shown in FIG. 8, among a time duration of 100 ms before a next scanning start signal STV is applied after a first scanning start signal STV is applied, there is a time duration of 84 ms excluding a time when the data Data signals for displaying different image are presented and that blank duration is called the new-image blanking time. During that new-image blanking time, the BPC/EN signal applied to the enable input terminal of the PMIC unit 650 has the high level, indicating that normal operation is blocked. As a result, in the PMIC unit 650, the normal AVDD voltage and the gate-on voltage Von are not generated. FIG. 8 only shows the AVDD voltage and the normal gate-on voltage Von (waveform for latter not shown) are not generated during the new-image blanking time.

Since the normal AVDD voltage and the normal gate-on voltage Von are not generated during the new-image blanking time, the responsive drivers that use and thus respond to the levels of the AVDD voltage and/or the gate-on voltage Von are not normally operated during the new-image blanking time but instead place themselves in low power or depowered modes.

That is, referring to the exemplary embodiment of FIG. 1, the drivers using the AVDD voltage and responsive to its level (normal versus sub-threshold) are the gray voltage generator 800, the data driver 500, and the DC-DC unit 660, and these may be operated in respective reduced power consumption modes during the new-image blanking time. Also, the gate driver 400 using the gate-on voltage Von may also not be operated normally during the new-image blanking time.

Differently from the exemplary embodiment of FIG. 1, in the exemplary embodiment of FIG. 7, the gate-on voltage Von is generated in the PMIC unit 650 and when the PMIC unit 650 is not enabled, the normal gate-on voltage Von of FIG. 7 is not generated.

Next, another method of not normally operating the drivers during the new-image blanking time will be described with reference to FIG. 9.

Figure 9:
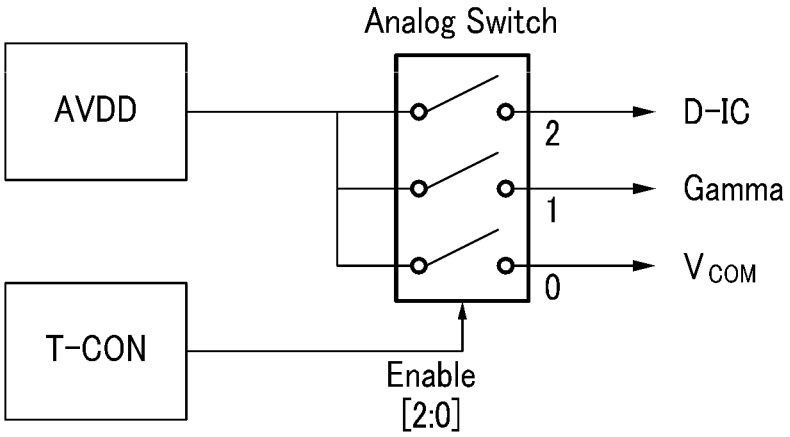
FIG. 9 is a block diagram of an application method of an AVDD voltage according to an exemplary embodiment.

FIG. 9 is a block diagram of an application method of an AVDD voltage according to an exemplary embodiment. Here, D-IC represents a normal operation enabling signal sent to the data driver 500, Gamma represents a normal operation enabling signal sent to the gray voltage generator 800, and Vcom-en represents a normal operation enabling signal sent to the DC-DC unit 660 where a Vcom reference voltage signal normally generated by the DC-DC unit 660 is then applied to a common electrode of the display panel.

In the exemplary embodiment of FIG. 9, an analog switch with three individually actuated armatures (preferably electronic ones, not mechanical ones) is used for selectively forwarding AVDD voltage which is generated in the PMIC unit 650 for respective application to the data driver 500 (the D-IC signal), to the gray voltage generator 800 (the Gamma signal), and to the DC-DC unit 660 (the Vcom-enable signal). As shown in FIG. 9, the multi-armature analog switch is disposed between the source of the AVDD voltage and the third controllable drivers that are controllable by withholding or providing the AVDD voltage. In other words, the respective armatures of the switch are respectively switched between respective turned on/off modes such that the AVDD voltage is selectively not applied during the new-image blanking time to at least one of the data driver 500, the gray voltage generator 800, and the DC-DC unit 660. In the illustrated embodiment, the operation of the switch armatures is controlled by a 3-bit enable signal Enable[2:0] applied from the signal controller 600 (T-CON).

In FIG. 9, the analog switch is shown, however a digital form switch such as a Mux may be used. Also, the enable signal Enable applied from the signal controller 600 may be a signal separately controlling three armatured switches.

A number of cases of turning on/off the AVDD voltage during the new-image blanking time according to the exemplary embodiment of FIG. 9 are as shown in the following Table 1.

TABLE 1

| | Data driver | Gray voltage generator | DC-DC unit |
|---|---|---|---|
| 1 | Non-application | Non-application | Non-application |
| 2 | Non-application | Application | Non-application |
| 3 | Application | Non-application | Non-application |
| 4 | Application | Application | Non-application |
| 5 | Non-application | Non-application | Application |
| 6 | Non-application | Application | Application |
| 7 | Application | Non-application | Application |

Here, Non-application means a case that the AVDD voltage is blocked, and Application is a case that the AVDD voltage being applied to the corresponding driver.

As shown in Table 1, there are a total of seven cases for the 3-bit control signal En[2:0], and the AVDD voltage is not applied to at least one driver during the new-image blanking time.

Among the seven cases, a case that the reduction ratio of the power consumption is good and a problem is not generated when the display device displays the image is the fifth case. That is, the AVDD voltage is not applied to the data driver 500 and the gray voltage generator 800 during the blank time to not be normally operated such that the power consumption is reduced, however the AVDD voltage is applied to the DC-DC unit 660 allowing the latter to normally generate the normal common voltage Vcom. When the normal common voltage Vcom is not applied, in the display panel, a display deterioration may be generated while the reference voltage is changed such that the common voltage Vcom may fail to be constantly and uniformly maintained across the display area during the new-image blanking time.

However, among the seven cases, when there is no problem for the power consumption and the display quality, the rest of the cases may all be applied.

In FIG. 9, only the application of the AVDD voltage is shown, however according to an exemplary embodiment, the DVDD voltage, the gate-on voltage Von, the gate-off voltage Voff, and the common voltage Vcom may be similarly selectively applied.

Next, an internal structure of a data driver 500 to which the DVDD voltage is selectively applied along with the AVDD voltage being selectively applied will be described with reference to FIG. 10 to FIG. 12.

Figure 10:
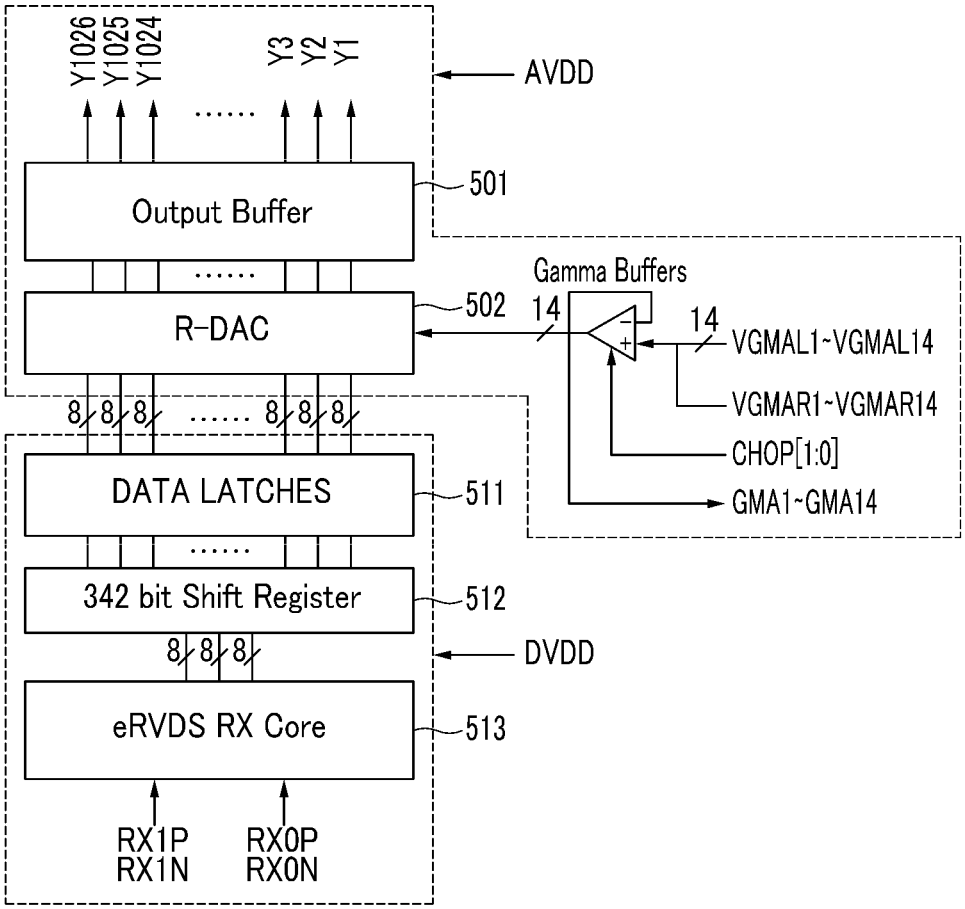
FIG. 10 is a block diagram of a data driver according to an exemplary embodiment.

FIG. 10 is a block diagram of a data driver according to an exemplary embodiment. FIG. 11 is an enlarged view of a portion using the normal AVDD voltage in a data driver during normal operations and according to the exemplary embodiment. FIG. 12 is a view of an enlarged portion using the normal DVDD voltage in a data driver during normal operations and according to an exemplary embodiment.

Firstly, FIG. 10 will now be described.

The data driver 500 according to an exemplary embodiment includes an output buffer unit 501 receiving both the AVDD voltage and the DVDD voltage as the power source voltages where an analog portion of the data driver 500 is driven by the AVDD voltage output from the selectively blockable analog power source voltage unit. The data driver 500 further includes a digital-analog converter (R-DAC) 502, latch units (data latches) 511 driven by the DVDD digital signals voltage as output from the selectively blockable digital power source voltage unit. The data driver 500 further includes a shift register (e.g., 342 bit shift register) 512, and a RVDS receiver (eRVDS RX core) 513 where the latter converts input serial data streams into more parallel ones.

More specifically, the RVDS receiver 513 has a portion configured for receiving serial data (R', G', B') applied from the signal controller 600 in an RVDS (reduced voltage differential signaling) method and it decodes the data (R', G', B') according to the RVDS method.

The shift register 512 receives a shift control signal (not shown) from the signal controller 600 to shift the decoded image data one group of same-colored subpixels at a time (each subpixel is 8 bits wide and 1026 divided by 3 is 342 bits) and to arrange the deserialized subpixels side by side (e.g., as 342 bits of side by side subpixels) and output them as such.

The latch unit 511 stores the arranged image data applied from the shift register 512 and outputs it according to the control signal applied from the signal controller 600.

The digital-analog converter 502 converts the digital image data signals applied from the latch unit 511 into corresponding analog data voltages. The digital to analog conversion process here uses the reference grayscale voltages GMA1-14 (e.g., gamma-corrected voltages) provided from the grayscale voltages generator 800.

The output buffer unit 501 stores the data voltages (e.g., capacitively) for a predetermined time and then outputs them to the Y1 through Y1026 data lines of the display panel 300 according to a control signal applied from the signal controller 600.

Figure 11:
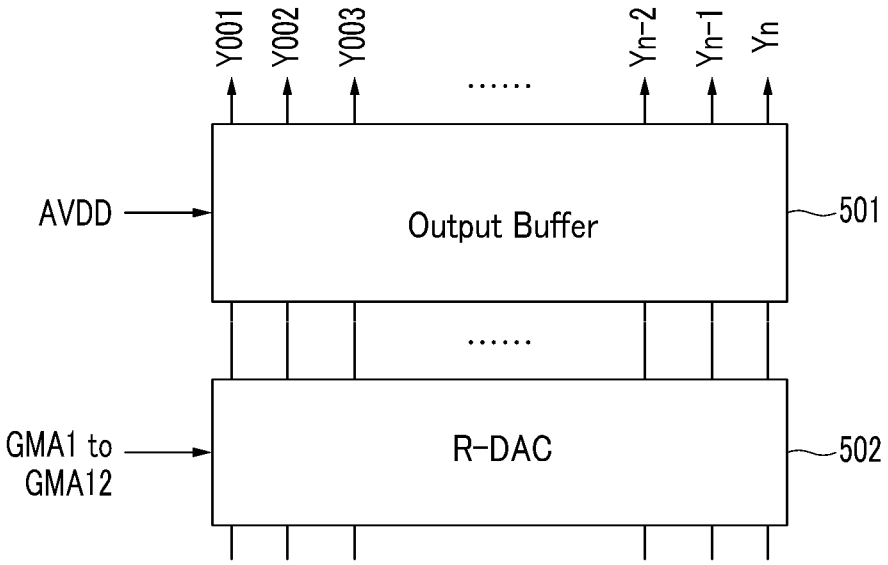
FIG. 11 is an enlarged view of a portion using an AVDD voltage in a data driver according to the exemplary embodiment of FIG. 10.

Referring to FIG. 10 and FIG. 11, the output buffer unit 501 and the digital-analog converter 502 among them use the AVDD voltage as the power source voltage such that the output buffer unit 501 and the digital-analog converter 502 are not normally operated if the normal AVDD voltage is not applied. That is, if the normal AVDD voltage is not applied to the data driver 500 during the new-image blanking time, the output buffer unit 501 and the digital-analog converter 502 are switched into a depowered mode and thus not operated such that the data voltages are not output to the data lines of the display panel 300 in the data driver 500, and as a result, the power consumption is reduced.

Also, the latch unit 511, the shift register 512, and the RVDS receiver 513 use the DVDD voltage as the power source voltage such that they are not normally operated if the normal DVDD voltage is not applied. That is, if the normal DVDD voltage is not applied to the data driver 500 during the new-image blanking time, the latch unit 511, so the shift register 512 and the RVDS receiver 513 are switched into respective depowered modes and thus not operated such that the data voltages are not output to the data line of the display panel 300 in the data driver 500, and as a result, the power consumption is reduced.

If the normal AVDD and DVDD voltages are not applied to the data driver 500, the output buffer unit 501, the digital-analog converter 502, the latch unit 511, the shift register 512, and the RVDS receiver 513 are not operated at full power but rather at substantially reduced power and thus power consumption is reduced.

Figure 12:
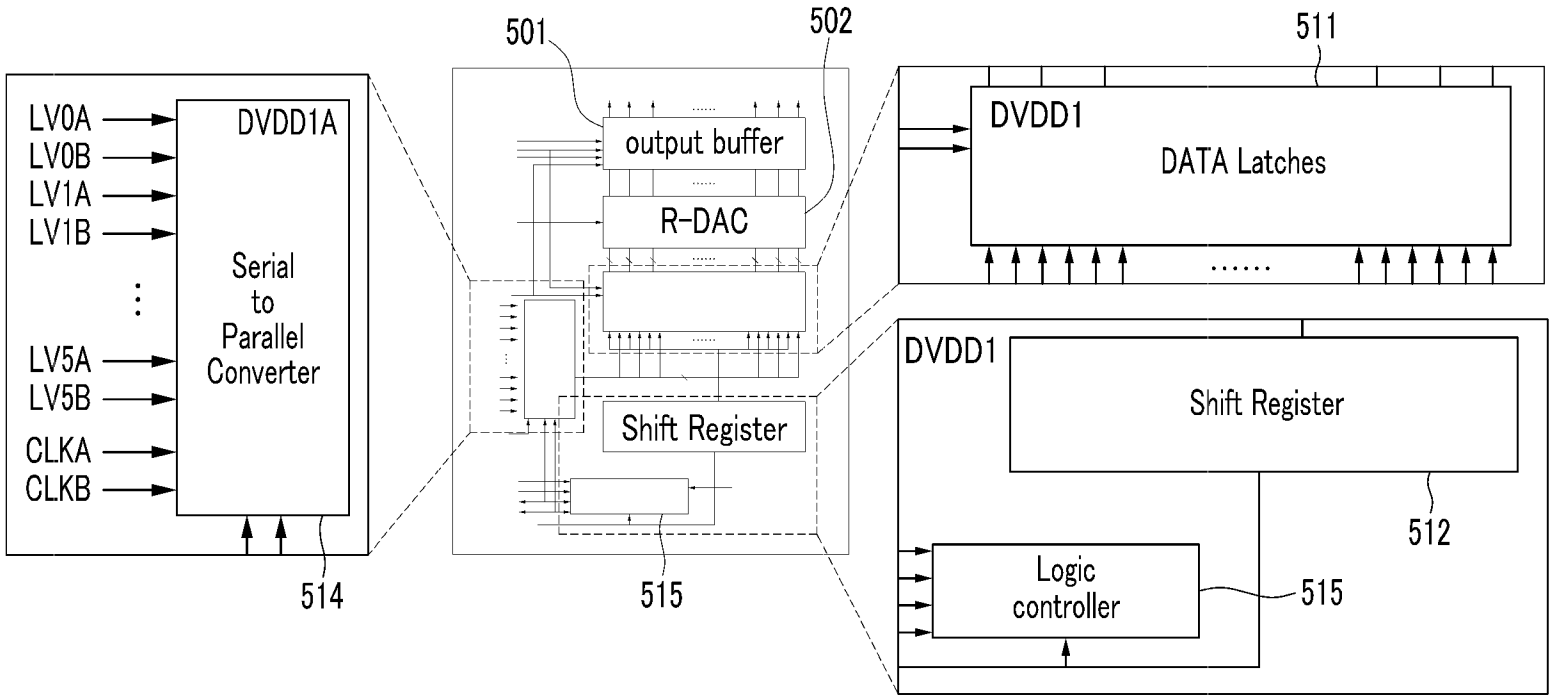
FIG. 12 is a view of an enlarged portion using a DVDD voltage in a data driver according to another exemplary embodiment.

Meanwhile, FIG. 12 is a block diagram of the data driver 500 according to another exemplary embodiment, and the data driver of FIG. 12 has a block of a portion using the DVDD voltage, differently from FIG. 10.

The exemplary embodiment of FIG. 12 includes a serial to parallel converter 514 and a logic controller 515 instead of the RVDS receiver 513.

The logic controller 515 and the serial to parallel converter 514 receive the data (R', G', B') applied from the signal controller 600 based on a control signal from the signal controller 600 to rearrange the data (R', G', B') that are arranged in series into parallel data. The rearranged parallel data (R', G', B') is then applied to the shift register 512 and are shifted to make an arrangement of side-by-side subpixels state to be processed in the data driver 500 and to output it.

The exemplary embodiment of FIG. 12 is an exemplary embodiment in which there are two kinds of DVDD voltage. That is, a DVDD1 voltage and a DVDD1A voltage are applied as the digital power source voltages (the DVDD voltages). The DVDD1 voltage is used as the digital power source voltage in the latch unit 511 and the shift register 512, and the DVDD1A voltage is used as the digital power source voltage in the serial to parallel converter 514.

In the exemplary embodiment of FIG. 12, it is therefore necessary to generate the two kinds of digital power source voltages, and in an exemplary embodiment at least one of the two digital power source voltages (DVDD1 and DVDD1A) is blocked during the new-image blanking time.

A number of cases of turning on/off the DVDD1 voltage and the DVDD1A voltage during the new-image blanking time according to the exemplary embodiment of FIG. 12 are as shown in the below Table 2.

TABLE 2

| | DVDD1 | DVDD1A |
|---|---|---|
| 1 | Non-application | Non-application |
| 2 | Non-application | Application |
| 3 | Application | Non-application |

Here, non-application is a case of blocking the corresponding digital power source voltage, and application is a case of applying the corresponding digital power source voltage.

As shown in Table 2, there are a total of three cases, and the digital power source voltage is not applied in at least one during the blank time.

For the three cases, the power consumption of a similar degree is decreased, and according to an exemplary embodiment, although any one among the three cases is applied, a difference is small in an aspect of the power consumption or the display quality.

However, according to an exemplary embodiment, the two digital power source voltages may be signals of the same level.

As described above, the digital power source voltage (the DVDD voltage) may be controlled, and in this case, when the analog power source voltage (the AVDD voltage) is applied and only the digital power source voltage (the DVDD voltage) is blocked, undesired voltage is output in the data driver 500 while the output buffer unit 501 is operated such that an undesired image may be displayed. This problem may be generated or not according to an exemplary embodiment, and in the exemplary embodiment in which this problem is generated, the deterioration of the display quality may be prevented through control like in FIG. 13.

Figure 13:
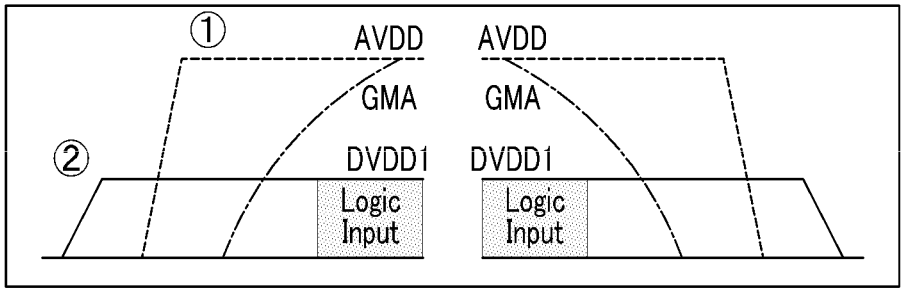
FIG. 13 is a timing diagram controlling a digital power source voltage and an analog power source voltage according to an exemplary embodiment.

FIG. 13 is a timing diagram for controlling a digital power source voltage and an analog power source voltage together according to an exemplary embodiment.

FIG. 13 shows voltage application timings of the normal AVDD voltage and the normal DVDD voltage (indicated by DVDD1) where the respective normal levels are the respective peak ones.

When blocking the DVDD voltage and the AVDD voltage together are selectively blocked, as is the case in the timing diagram of FIG. 13, the DVDD voltage is firstly applied (earlier deblocked), and then the AVDD voltage is applied after a predetermined time, and then; later when the new-image blanking time starts again, it is the AVDD voltage which is firstly blocked and then the DVDD voltage is blocked. Referring to FIG. 3 and FIG. 8, the time when the AVDD voltage is applied is the new-image blanking time such that the AVDD voltage is blocked corresponding to the blank time, however a period in which the DVDD voltage is partially applied may exist during the blank time. That is, after the new-image blanking time starts, the DVDD voltage is blocked after the predetermined time, and the DVDD voltage is applied before a predetermined time after the blank time is finished. Here, the predetermined time after the blank time starts and the predetermined time before the blank time is finished may be different times.

Like FIG. 13, by applying (deblocking) the DVDD voltage before the AVDD voltage is applied, the portion (the latch unit 511, the shift register 512, the RVDS receiver 513, and the serial to parallel converter 514) that is positioned at an input side of the data driver 500 to be firstly operated are firstly enabled to be normally operated, and next, the portion (the output buffer unit 501 and the digital-analog converter 502) that is positioned at an output side of the data driver 500 to be secondarily normally operated based on valid data received from the already normally operated digital circuits.

Also, by blocking the DVDD voltage after the AVDD voltage is blocked, the portion (the latch unit 511, the shift register 512, the RVDS receiver 513, and the serial to parallel converter 514) that is positioned at an input side of the data driver 500 to be firstly operated is firstly blocked, and next, the portion (the output buffer unit 501 and the digital-analog converter 502) that is positioned at an output side of the data driver 500 to be secondarily operated is secondarily blocked. At this time, the output side of the data driver 500 is set up for only the data provided at the input to be output such that an image that is not provided may not be displayed.

As shown in FIG. 13, the portion of the period among the DVDD voltage may include a period when a logic input signal is applied.

Also, in FIG. 13, the GMA curves represent the ramping up and discharge of the respective reference grayscale voltages, and may be set up to be generated while the gray voltage generator 800 is operated after the AVDD voltage is applied and to not previously output before the AVDD voltage is removed.

Next, an exemplary embodiment of blocking the operation of the data driver 500 by using the clock signal will be described with reference to FIG. 14 and FIG. 15.

Figure 14:
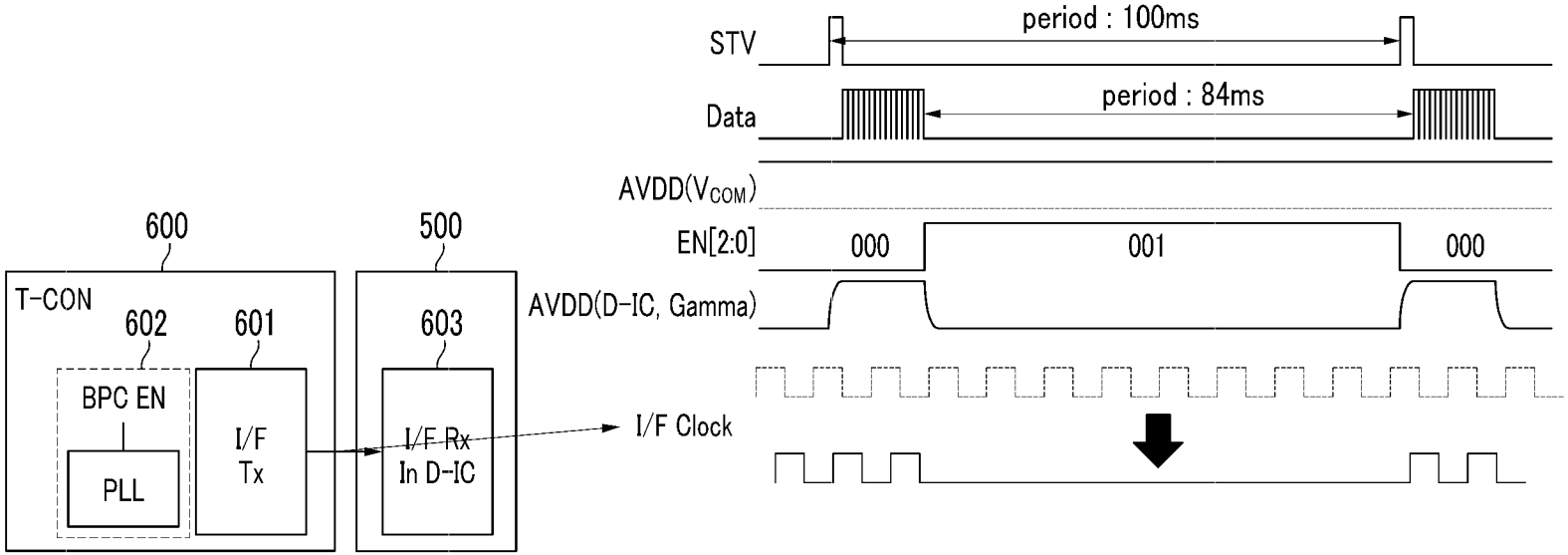
FIG. 14 and FIG. 15 are a block diagram and a timing diagram, respectively, for a method of reducing power consumption by using a clock signal according to an exemplary embodiment.
Figure 15:
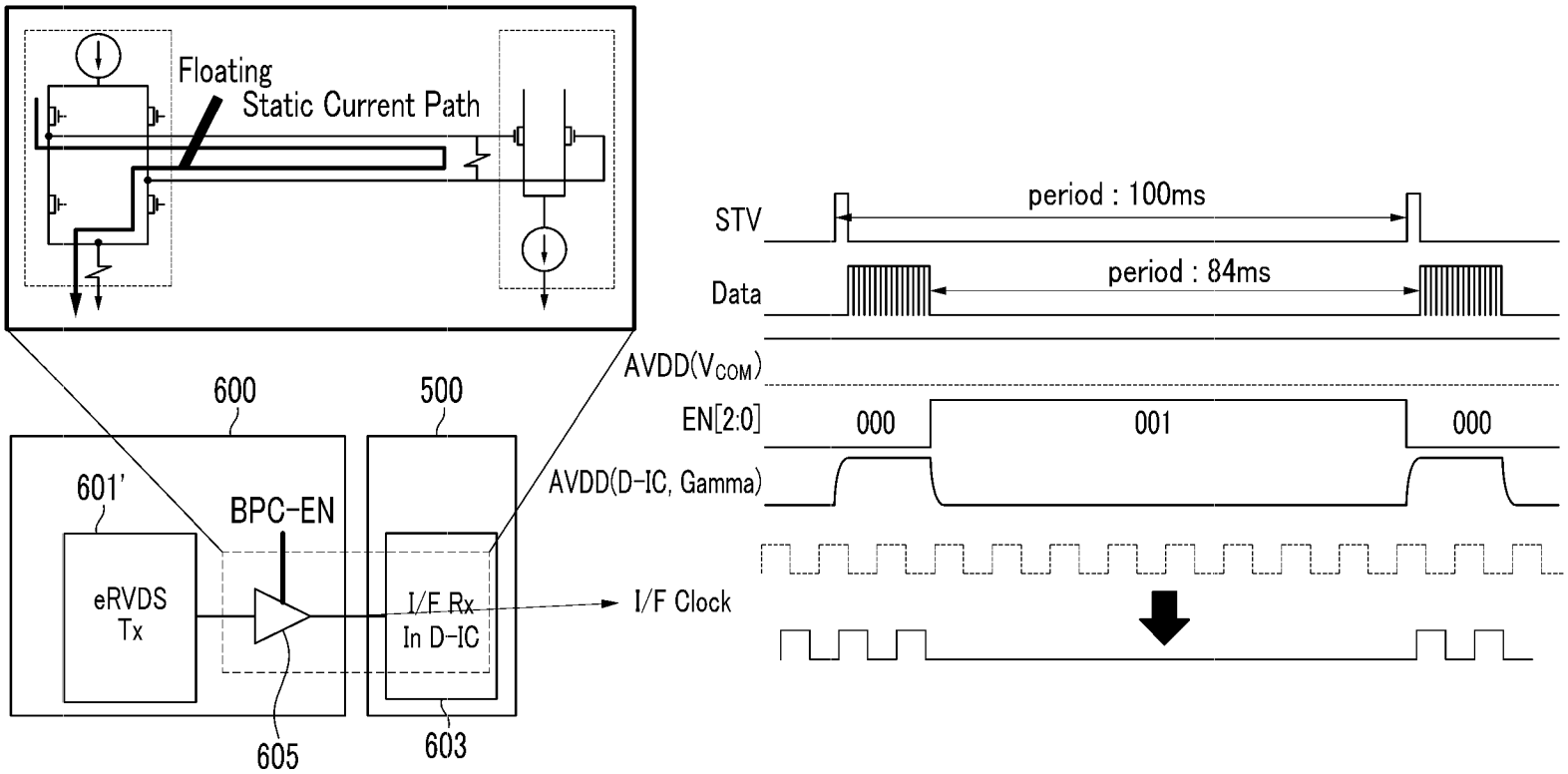

FIG. 14 and FIG. 15 are respectively a block diagram and a timing diagram for a method of reducing power consumption by selectively using and not using a clock signal as needed and according to an exemplary embodiment.

FIG. 14 and FIG. 15 show an exemplary embodiment of blocking the clock signal applied between the signal controller (600; T-con) and the data driver 500 for the data driver 500 to not be operated during the new-image blanking time.

Firstly, FIG. 14 shows an exemplary embodiment of selectively not generating the clock signal by turning on/off a utilized phase lock loop (PLL) unit 602 that is configured for generating the clock signal (I/F CLK) inside the signal controller 600.

In FIG. 14, the signal controller 600 includes the PLL unit 602 generating the clock signal and an interface (I/F) output terminal (Tx) 601. The PLL unit 602 generating the clock signal selectively generates or blocks the clock signal in accordance with a BPC-enable signal BPC/EN provided inside the signal controller 600. Referring to the timing diagram of FIG. 14, when the BPC enable signal BPC EN is high, the PLL unit 602 does not generate the clock signal. A time when the BPC enable signal BPC/EN is high is the blank time. When the BPC enable signal BPC/EN is low, the PLL unit 602 responsively generates the clock signal.

The clock signal generated by the PLL unit 602 is transmitted to the interface (I/F) output terminal 601 positioned inside the signal controller 600.

Meanwhile, a data driver (D-IC) 500 further includes an interface (I/F) receiving terminal (Rx) 603 positioned therein as shown in FIG. 15.

The interface (I/F) receiving terminal 603 of the data driver 500 receives and transmits the clock signal output from the interface (I/F) output terminal 601 to at least a portion (the latch unit 511, the shift register 512, the RVDS receiver 513, the serial to parallel converter 514, the output buffer unit 501, and the digital-analog converter 502) of the data driver 500 to be operated according to the corresponding clock signal.

When the BPC-enable signal BPC/EN has a high value such that the PLL unit 602 does not generate the clock signal, the interface (I/F) receiving terminal 603 is not applied with the clock signal such that at least a portion positioned inside the data driver 500 is not operated without the clock signal that is the reference for the operation. Instead a static float state is maintained. As a result, the power consumption is decreased during the blank time.

Referring to the waveform diagram of FIG. 14, in the exemplary embodiment of FIG. 14, the AVDD voltage is not generated during the blank time and the clock signal is not applied to the data driver (D-IC) 500 and the gray voltage generator (Gamma) 800. However, in the exemplary embodiment of FIG. 14, the AVDD voltage is also operated for generating the common voltage Vcom where the latter optionally is not be generated during the blank time, and according to the exemplary embodiment of FIG. 1, in which case the display panel may show artifacts. To counter this, the AVDD voltage is applied to the DC-DC unit 660 even during the blank time.

However, differently from FIG. 14, the AVDD voltage may be applied during the blank time, and the common voltage Vcom may also be generated during the blank time. Also, various exemplary variations according to the previous exemplary embodiment may be applied.

Also, in FIG. 14, only one wire applying the clock signal is shown between the signal controller 600 and the data driver 500, however a wire applying the data (R', G', B') and a wire applying the clock signal may be separately formed. Also, wires applying various control signals may be separately formed.

Meanwhile, differently from FIG. 14, FIG. 15 is an exemplary embodiment in which the wire connected between the output terminal (eRVDS Tx) 601' of the signal controller 600 and the interface (I/F) receiving terminal 603 of the data driver 500 is disconnected by tristate unit 605 for the clock signal to not be applied to the data driver 500.

In the exemplary embodiment of FIG. 15, like in FIG. 14, the PLL unit 602 generating the clock signal to the signal controller 600 may be formed.

Also, in the exemplary embodiment of FIG. 15, a tri-state output unit 605 for providing a high impedance output when in disconnect mode is positioned at an end of the output terminal (eRVDS Tx) 601' of the signal controller 600, and the output unit 605 outputs or does not output the clock signal by the BPC-enable signal (BPC/EN) inside the signal controller 600.

The signal controller 600 and the data driver 500 according to the exemplary embodiment of FIG. 15 transmits/receives the signal by a differential signaling method. In FIG. 15, among the differential signaling method, a RVDS method is used, and an LVDS method may also be used.

The differential signaling method uses two wires (a pair of wires) when transmitting/receiving the signal as shown in the enlarged upper portion of FIG. 15. By applying the signal with a voltage difference through the two wires, signal application with a low voltage is possible. In the differential signaling method of applying the signal through two wires, a current path through which a current flows in an arrow direction (or a reverse direction thereto) during the blank time may be formed, and accordingly power is undesirably consumed. Therefore, in the exemplary embodiment of FIG. 15, one among the wires between the output unit 605 and the interface (I/F) receiving terminal (Rx) 603 of the data driver (D-IC) 500 is floated or disconnected by application of an inverse of the BPC-enable signal (BPC/EN) to the tri-state output unit 605. As a result, the data driver 500 may not be applied with the clock signal during the blank time, and the power consumption may be reduced.

Referring to the waveform diagram of FIG. 15, in the exemplary embodiment of FIG. 15, the clock signal is not generated during the blank time and the AVDD voltage is also not generated such that the AVDD voltage is not applied to the data driver (D-IC) 500 and the gray voltage generator (Gamma) 800. However, in the exemplary embodiment of FIG. 15, the AVDD voltage is operated to not generate the common voltage Vcom during the blank time, and according to the exemplary embodiment of FIG. 1, the AVDD voltage is applied to the DC-DC unit 660 during the blank time.

However, differently from FIG. 15, the AVDD voltage may be applied during the blank time, or the common voltage Vcom may also not be generated during the blank time. Also, various exemplary variations according to the previous exemplary embodiment may be applied.

Also, in FIG. 15, as well as the wire applying the clock signal between the signal controller 600 and the data driver 500, a wire applying the data (R', G', B') and the wire applying the clock signal may be separately formed. Also, the wire applying the clock signal and the wire applying the data (R', G', B') may form a pair of wires. Further, wires (a pair of wires) applying various control signals may be separately formed.

Next, an effect of reducing the power consumption according to an exemplary embodiment will be described with reference to FIG. 16.

Figure 16:
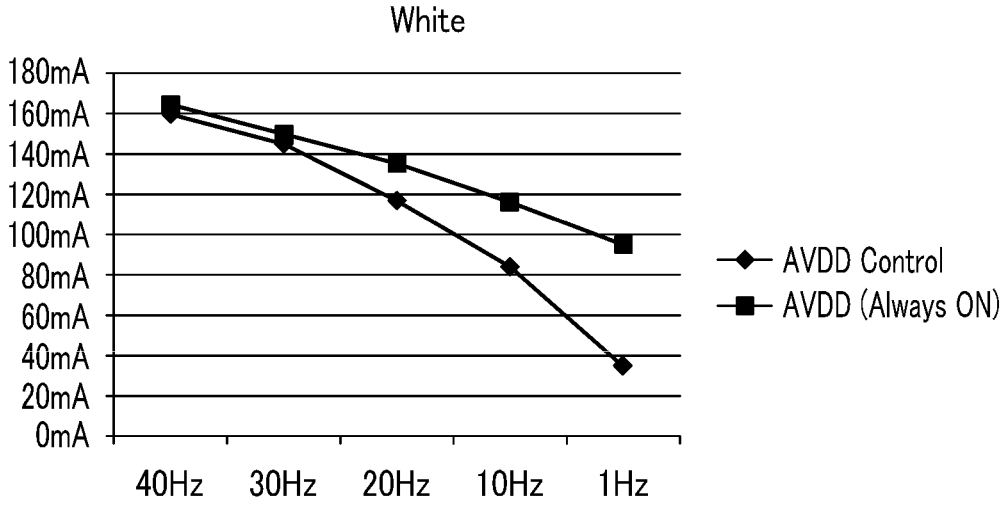
FIG. 16 is a graph of current consumption according to an image display frequency for an exemplary embodiment and a comparative example.

FIG. 16 is a graph of current consumption according to an image display frequency for an exemplary embodiment and a comparative example.

A comparative example of FIG. 16 is a case in which a power source voltage, a clock signal, etc., are all applied to each driver during the new-image blanking time, and an exemplary embodiment is a case 5 (where only the common voltage Vcom is generated) among the exemplary embodiment of Table 1.

In FIG. 16, the x-axis is an image display frequency (refreshed frames per second) of the display device and the y-axis is current consumption. Those skilled in the art will appreciate that the case of the frame refresh being less than about 10 times per second (less than 10 Hz) can correspond to the case of displaying a still image.

As shown in FIG. 16, when the image display frequency is high, a difference of the current consumption is not large, and when the image display frequency is low, the difference of the power consumption between AVDD being always on and AVDD being selectively shut off (during the new-image blanking time) is large.

That is, when the display device displays the motion picture (at the higher frequencies) as compared to when it displays the still image (at the lower frequencies), then it makes little difference as to shutting AVDD off in between the supplying of successively newer frames of image data. On the other hand, if at least one of the drivers is selectively not operated during the new-image blanking time when displaying the still image (at the lower frame refresh rate), the difference of the power consumption may be large compared with the comparative example of motion pictures. However, in the case of the motion picture or with the image display frequency of more than a predetermined degree, at least one of the drivers may not be operated during the blank time, and the large difference is not generated, however the power consumption may be reduced somewhat such that this exemplary embodiment may also be applied.

While this disclosure of invention has been described in connection with what are presently considered to be practical exemplary embodiments, it is to be understood that the teachings are not limited to the disclosed embodiments, but, on the contrary, the teachings are intended to cover various modifications and equivalent arrangements included within the spirit and scope of the teachings.

What is claimed is:

1. A display device comprising:

a display panel comprising a plurality of gate lines, a plurality of data lines, and a plurality of pixel units respectively connected to corresponding ones of the gate lines and the data lines;

a data driver connected to the data lines;

a gate driver connected to the gate lines;

a signal controller operatively coupled for and configured for controlling operations of the data driver and of the gate driver, one or more power voltage sourcing units configured for selectively producing corresponding power source voltage signals when enabled and for not producing the power source voltage signals when disabled;

wherein the signal controller is operatively coupled to control at least one of the power voltage sourcing units that is coupled to provide a respective first power source voltage to the data driver and the signal controller is configured to cause that at least one power voltage sourcing unit to not supply its respective first power source voltage signal during a new-image blanking time, the latter time being one in which the signal controller does not supply image data to the data driver, wherein further comprising a monolithically integrated circuit that includes a power management integrated circuit (PMIC) unit configured to generate the first power source voltage from an external power source, wherein the external power source is blocked during the new-image blanking time.

2. The display device of claim 1, wherein the first power source voltage is an analog circuits powering voltage (AVDD).

3. The display device of claim 2, further comprising a grayscale voltages generator configured to generate and output a plurality of different grayscale reference voltages for use by the data driver, wherein the grayscale voltages generator is operatively coupled so as to receive the analog circuits powering voltage during normal operations of the grayscale voltages generator, but is so coupled as to not receive the analog circuits powering voltage during the new-image blanking time of the display device.

4. The display device of claim 3, wherein the grayscale voltages generator comprises plural memory banks including a new-image blanking time bank storing one or more new-image blanking time power control signals representing respective grayscale voltages that are to be output during the new-image blanking time.

5. The display device of claim 4, wherein the one or more new-image blanking time power control signals all represent a BPC gray voltage set at a 0 V voltage.

6. The display device of claim 3, further comprising a DC-to-DC power conversion unit configured to supply a common voltage to a common electrode of the display panel.

7. The display device of claim 6, wherein the DC-to-DC power conversion unit is operatively coupled so as to receive the analog circuits powering voltage during normal operations of the grayscale voltages generator, but is so coupled as to not receive the analog circuits powering voltage during the new-image blanking time of the display device.

8. The display device of claim 6, wherein the DC-to-DC power conversion unit is configured to generate at least one of a gate-on voltage or a gate-off voltage used by the gate driver as well as to generate the common voltage.

9. The display device of claim 6, wherein the DC-to-DC power conversion unit is configured to generate both of the gate-off voltage and the common voltage, and the DC-to-DC power conversion unit includes a first subunit configured for generating the gate-off voltage and a separate second subunit configured for generating the common voltage.

10. The display device of claim 6, wherein the data driver, the grayscale voltages generator, and the DC-to-DC power conversion unit are all operatively coupled to receive the analog circuits powering voltage (AVDD), the data driver and the grayscale voltages generator are operatively coupled so as to not receive the analog circuits powering voltage during the new-image blanking time, and the DC-to-DC unit is operatively coupled so as to contrastingly receive the analog circuits powering voltage during the new-image blanking time.

11. The display device of claim 10, wherein the data driver comprises an output buffer unit, a digital-analog converter, a latch unit, and a shift register, and the output buffer unit and the digital-analog converter are configured to normally receive the analog circuits powering voltage, but are operatively coupled to not receive the analog circuits powering voltage during the new-image blanking time.

12. The display device of claim 2, wherein the PMIC unit is configured to further generate a gate-on voltage or a common voltage as well as the first power source voltage.

13. The display device of claim 2, wherein the signal controller is operatively coupled to further control a second of the power voltage sourcing units that is coupled to provide a respective second power source voltage, the second power source voltage being a digital circuits powering voltage.

14. The display device of claim 13, wherein the digital circuits powering voltage is operatively coupled to the data driver during a normal operating time of the display device, and both of the analog circuits powering voltage and the digital circuits powering voltage are operatively coupled so as to not be applied to the data driver during the new-image blanking time.

15. The display device of claim 14, wherein the data driver comprises an output buffer unit, a digital-analog converter, a latch unit, and a shift register, and the output buffer unit and the digital-analog converter receive the analog circuits powering voltage during a normal operating time of the display device but not receive the analog circuits powering voltage during the new-image blanking time.

16. The display device of claim 15, wherein the latch unit and the shift register receive the digital circuits powering voltage during a normal operating time of the display device, but do not receive the digital circuits powering voltage during the new-image blanking time.

17. The display device of claim 15, further comprising a gray voltage generator configured for transmitting different grayscale voltages to the data driver, wherein the gray voltage generator is configured to receive the digital circuits powering voltage and the analog circuits powering voltage during normal operations, but does not receive the digital circuits powering voltage or the analog circuits powering voltage during the new-image blanking time.

18. The display device of claim 13, wherein the digital circuits powering voltage is firstly applied, the analog circuits powering voltage is applied after a predetermined time after the digital circuits powering voltage is applied, and thereafter, the analog circuits powering voltage is firstly blocked, and then the digital circuits powering voltage is afterwards blocked.

19. The display device of claim 18, wherein the time when the analog circuits powering voltage is not applied is the new-image blanking time.

20. The display device of claim 2, wherein the first power source voltage is a digital circuits powering voltage.

21. The display device of claim 20, wherein the data driver comprises an output buffer unit, a digital-analog converter, a latch unit, and a shift register, and the latch unit and the shift register receive the digital circuits powering voltage, but do not receive the digital circuits powering voltage during the new-image blanking time.

22. The display device of claim 20, further comprising a gray voltage generator configured for transmitting gray voltages to the data driver, wherein the gray voltage generator is operatively coupled to receive the digital circuits powering voltage during normal operations, but does not receive the digital circuits powering voltage during the new-image blanking time.

23. A display device comprising:

a display panel comprising a gate line, a data line, and a pixel connected to the gate line and the data line;

a data driver connected to the data line;

a gate driver connected to the gate line; and a signal controller configured for controlling the data driver and the gate driver, wherein, the signal controller is configured to generate an enable signal, a clock signal is not generated during a new-image blanking time according to the enable signal, and wherein the signal controller is configured to cause the clock signal to not be applied to the data driver during the new-image blanking time when the signal controller is concurrently not supplying new image data to the data driver.

24. The display device of claim 23, wherein the signal controller comprises a phase lock loop (PLL) unit configured for generating the clock signal and an output terminal for outputting the clock signal, the data driver comprises a receiving terminal configured for receiving the clock signal, and the PLL unit is controlled by an enable signal of the signal controller such that the clock signal is not generated during the new-image blanking time.

25. The display device of claim 23, wherein the signal controller comprises an output terminal outputting the clock signal, the data driver comprises a receiving terminal receiving the clock signal, and the output terminal does not output the clock signal during the new-image blanking time by the enable signal of the signal controller.

26. The display device of claim 25, wherein the output terminal and the receiving terminal are connected as a pair of wires, and one of the pair of wires is selectively floated during the new-image blanking time when the clock signal is to not be output.

27. The display device of claim 23, wherein the signal controller does not apply a power source voltage driving the data driver during the new-image blanking time when the image data is not applied to the data driver.

28. The display device of claim 27, wherein the power source voltage is an analog circuits powering voltage.

29. The display device of claim 28, further comprising a gray voltage generator transmitting a gray voltage to the data driver, wherein the gray voltage generator receives the analog circuits powering voltage during normal operations, but does not receive the analog circuits powering voltage during the new-image blanking time.

30. The display device of claim 29, further comprising a DC-to-DC power conversion unit configured for applying a common voltage to a common electrode of the display panel.

31. The display device of claim 30, wherein the DC-DC unit receives the analog circuits powering voltage during normal operations, but does not receive the analog power source voltage during the new-image blanking time.

32. The display device of claim 30, wherein the DC-DC unit generates at least one of a gate-on voltage, a gate-off voltage, and the common voltage.

33. The display device of claim 30, wherein the data driver, the gray voltage generator, and the DC-DC unit are configured to receive the analog circuits powering voltage during normal operations, the data driver and the gray voltage generator are operatively coupled to not receive the analog circuits powering voltage during the new-image blanking time, and the DC-DC unit is operatively coupled to receive the analog circuits powering voltage during the new-image blanking time.

34. The display device of claim 33, wherein the data driver comprises an output buffer unit, a digital-analog converter, a latch unit, and a shift register, and the output buffer unit and the digital-analog converter receive the analog circuits powering voltage during normal operations, but do not receive the analog circuits powering voltage during the new-image blanking time.

35. A machine-implemented method of selectively driving a display device comprising a display panel that includes a gate line, a data line, and a pixel connected to the gate line and the data line, a data driver connected to the data line, a gate driver connected to the gate line, and a signal controller controlling the data driver and the gate driver, and a monolithically integrated circuit that includes a power management integrated circuit (PMIC) unit configured to generate a first power source voltage from an external power source, the method comprising blocking the external power source during a new-image blanking time when the signal controller is concurrently not supplying new image data to the data driver, selectively not applying a circuits powering source voltage driving the data driver during the new-image blanking time when the signal controller is concurrently not supplying new image data to the data driver.

36. The method of claim 35, wherein the circuits powering source voltage is an analog circuits powering voltage.

37. The method of claim 36, wherein the display device further comprises a gray voltage generator transmitting the gray voltage, and the signal controller does not apply the analog circuits powering voltage to the gray voltage generator receiving the analog power source voltage during the new-image blanking time.

38. The method of claim 37, wherein the gray voltage generator comprises a plurality of memory banks including one storing a blank time power control (BPC) gray voltage for output during the new-image blanking time, and the gray voltage generator outputs the BPC gray voltage during the new-image blanking time.

39. The method of claim 38, wherein the BPC gray voltage has a 0 V voltage.

40. The method of claim 37, wherein the display device further comprises a DC-DC unit applying a common voltage to the display panel.

41. The method of claim 40, wherein the signal controller does not apply the analog power source voltage to the DC-DC unit receiving the analog circuits powering voltage during the new-image blanking time.

42. The method of claim 40, further comprising generating at least one among a gate-on voltage, a gate-off voltage, and the common voltage by the DC-DC unit.

43. The method of claim 40, further comprising generating a gate-off voltage and a common voltage by the DC-DC unit, and wherein a first subunit of the DC-DC unit is configured for generating the gate-off voltage and a second subunit of the DC-DC unit is configured for generating the common voltage.

44. The method of claim 40, wherein for the data driver, the gray voltage generator, and the DC-DC unit receiving the analog circuits powering voltage, the signal controller controls the data driver and the gray voltage generator to not be applied with the analog circuits powering voltage during the new-image blanking time, and the DC-DC unit to be applied with the analog circuits powering voltage during the new-image blanking time.

45. The method of claim 44, wherein the data driver comprises an output buffer unit, a digital-analog converter, a latch unit, and a shift register, and the signal controller controls the output buffer unit and the digital-analog converter receiving the analog power source voltage to be applied with the analog power source voltage during the new-image blanking time.

46. The method of claim 36, wherein the PMIC unit further generates the gate-on voltage or the common voltage as well as a power source voltage.

47. The method of claim 36, wherein the circuits powering source voltages also comprise a digital circuits powering voltage.

48. The method of claim 47, wherein the signal controller controls the data driver receiving the digital circuits powering voltage to not be applied with the analog circuits powering voltage or the digital circuits powering voltage during the new-image blanking time.

49. The method of claim 48, wherein the data driver comprises an output buffer unit, a digital-analog converter, a latch unit, and a shift register, and the signal controller controls the output buffer unit and the digital-analog converter receiving the analog circuits powering voltage to not be applied with the analog circuits powering voltage during the new-image blanking time.

50. The method of claim 49, wherein the signal controller controls the latch unit and the shift register receiving the digital circuits powering voltage to not be applied with the digital circuits powering voltage during the new-image blanking time.

51. The method of claim 49, wherein the display device further comprises a gray voltage generator configured for transmitting a gray voltage to the data driver, and the signal controller selectively controls the gray voltage generator normally receiving the analog circuits powering voltage and the digital circuits powering voltage to not be applied with the digital circuits powering voltage or the analog circuits powering voltage during the new-image blanking time.

52. The method of claim 47, wherein the digital power circuits powering voltage is firstly applied, the analog circuits powering voltage is applied after a predetermined time after the digital power circuits powering voltage is firstly applied, and next, the analog circuits powering voltage is selectively blocked before the digital circuits powering voltage is blocked.

53. The method of claim 52, wherein the time when the analog circuits powering voltage is not applied is the new-image blanking time.

54. The method of claim 36, wherein a power source voltage includes a digital circuits powering voltage.

55. The method of claim 54, wherein the data driver comprises an output buffer unit, a digital-analog converter, a latch unit, and a shift register, and the signal controller controls the latch unit and the shift register normally receiving the digital circuits powering voltage not to be applied with the digital circuits powering voltage during the new-image blanking time.

56. The method of claim 54, further comprising a gray voltage generator transmitting a gray voltage to the data driver, wherein the signal controller controls the gray voltage generator normally receiving the digital circuits powering voltage to not be applied with the digital circuits powering voltage during the new-image blanking time.

57. A method of driving a display device a display panel comprising a gate line, a data line, and a pixel connected to the gate line and the data line, a data driver connected to the data line, a gate driver connected to the gate line, and a signal controller controlling the data driver and the gate driver and generating an enable signal, the method comprising not generating a clock signal during a new-image blanking time according to the enable signal, selectively not applying the clock signal to the data driver during the new-image blanking time when the signal controller is concurrently not supplying new image data to the data driver.

58. The method of claim 57, wherein the signal controller comprises a phase lock loop (PLL) unit configured for generating the clock signal and an output terminal outputting the clock signal, the data driver comprises a receiving terminal for receiving the clock signal, and the signal controller controls the PLL unit by an enable signal so as to selectively not generate the clock signal during the new-image blanking time.

59. The method of claim 57, wherein the signal controller comprises an output terminal for outputting the clock signal, the data driver comprises a receiving terminal for receiving the clock signal, and the signal controller controls the output terminal by an enable signal to selectively not output the clock signal during the new-image blanking time.

60. The method of claim 59, wherein the output terminal and the receiving terminal are connected as a pair of wires, and the signal controller floats one of the pair of wires for the clock signal to not be output.

61. The method of claim 57, wherein the signal controller does not apply the power source voltage driving the data driver during the new-image blanking time where the latter is when the image data is not being supplied to the data driver.

62. The method of claim 61, wherein the power source voltage is an analog power source voltage.

63. The method of claim 62, wherein the display device further comprises a gray voltage generator transmitting a gray voltage to the data driver, and the signal controller controls the gray voltage generator normally receiving the analog circuits powering voltage to be not applied with the analog circuits powering voltage during the new-image blanking time.

64. The method of claim 63, wherein the display device further comprises a DC-DC unit applying a common voltage to the display panel.

65. The method of claim 64, wherein the signal controller controls the DC-DC unit receiving the analog power source voltage to not be applied with the analog power source voltage during the new-image blanking time.

66. The method of claim 64, wherein the DC-DC unit generates at least one of the gate-on voltage, the gate-off voltage, and the common voltage.

67. The method of claim 64, wherein for the data driver, the gray voltage generator, and the DC-DC unit receiving the analog circuits powering voltage, the signal controller controls the data driver and the gray voltage generator to not be applied with the analog circuits powering voltage during the new-image blanking time, and the DC-DC unit to continue to be applied with the analog circuits powering voltage during the new-image blanking time.

68. The method of claim 67, wherein the data driver comprises an output buffer unit, a digital-analog converter, a latch unit, and a shift register, the signal controller controls the output buffer unit and the digital-analog converter normally receiving the analog circuits powering voltage to not be applied with the analog circuits powering voltage during the new-image blanking time.

* * * * *